US007864142B2

(12) United States Patent
Tanahashi et al.

(10) Patent No.: US 7,864,142 B2
(45) Date of Patent: Jan. 4, 2011

(54) LIGHT-EMITTING DIODE DRIVE CIRCUIT, LIGHT SOURCE DEVICE, AND DISPLAY DEVICE

(75) Inventors: Makoto Tanahashi, Kanagawa (JP); Kiyohito Fujita, Kanagawa (JP)

(73) Assignee: Sony Corporation, Tokyo (JP)

( * ) Notice: Subject to any disclaimer, the term of this patent is extended or adjusted under 35 U.S.C. 154(b) by 1010 days.

(21) Appl. No.: 11/456,434

(22) Filed: Jul. 10, 2006

(65) Prior Publication Data

US 2007/0013620 A1 Jan. 18, 2007

(30) Foreign Application Priority Data

Jul. 14, 2005 (JP) ..... P2005-205761

(51) Int. Cl.
*G09G 3/32* (2006.01)

(52) U.S. Cl. ..... 345/82; 345/44

(58) Field of Classification Search ..... 345/82, 345/83, 39, 44, 46
See application file for complete search history.

(56) References Cited

U.S. PATENT DOCUMENTS 6,597,119 B2 * 7/2003 Ito ..... 315/169.1

FOREIGN PATENT DOCUMENTS

| | | |
|---|---|---|
| JP | 2003-100472 | 4/2003 |
| JP | 2004-039290 | 2/2004 |
| JP | 2004-319583 | 11/2004 |

* cited by examiner

*Primary Examiner*—Srilakshmi K Kumar
(74) *Attorney, Agent, or Firm*—SNR Denton US LLP

(57) ABSTRACT

A display device includes a light source device and an image display panel operable to display an image using light emitted from the light source device. The light source device includes a plurality of series drive circuits each including a predetermined number of series-connected light-emitting diodes, a constant-current circuit outputting a constant amount of current to one of the plural series drive circuits serving as a reference, the plural series drive circuits being connected in parallel with the current output, a current mirror circuit operable to allow the same amount of current to flow through the plural series drive circuits, and a voltage dropping circuit operable to cause a voltage drop of a predetermined level in the series drive circuit serving as the reference, the voltage dropping circuit being disposed in series with the light-emitting diodes forming the series drive circuit serving as the reference.

14 Claims, 13 Drawing Sheets

1
10
Din
Dout
CONSTANT-CURRENT CIRCUIT (IC)
FB
Vi
Vo
21
22
23
24
D10
D11
D12
D18
D19
D20
D21
D22
D28
D29
D30
D31
D32
D38
D39
D40
D41
D42
D48
D49
Q1
Q2
Q3
Q4
R11
R21
R31
R41
VOLTAGE DROPPING CIRCUIT
11
Vd =10V
30V (3×10)
40V (4×10)
41V
0.7V
0.3V

LIGHT-EMITTING DIODE DRIVE CIRCUIT, LIGHT SOURCE DEVICE, AND DISPLAY DEVICE

CROSS REFERENCES TO RELATED APPLICATIONS

The present invention contains subject matter related to Japanese Patent Application JP 2005-205761 filed in the Japanese Patent Office on Jul. 14, 2005, the entire contents of which are incorporated herein by reference.

BACKGROUND OF THE INVENTION

1. Field of the Invention

The present invention relates to light-emitting diode (LED) drive circuits, light source devices including the LED drive circuits, and display devices including the light source devices.

2. Description of the Related Art

Liquid crystal displays (LCDs) including liquid crystal panels as display devices are widely used. As is generally known, liquid crystal panels display an image by modulating, instead of natural light, white light emitted from so-called "backlight", which is a light source device, using a video signal.

Cold-cathode tubes are widely employed as light sources for LCDs. Due to improvement in luminous efficiency of LEDs in recent years, LCDs using LEDs as light sources have become known. Compared with cold-cathode tubes, LEDs have the following advantages: LEDs are environment-friendly since they do not use mercury as the material thereof; LEDs can be driven by a lower voltage; LEDs have good temperature characteristics and response characteristics; and LEDs have long life. It is thus expected that LCDs using LEDs will be widely used in the future.

Inventions regarding light source devices (illumination devices) using LEDs as light sources for LCDs, such as those described above, are described in, for example, Japanese Unexamined Patent Application Publication Nos. 2003-100472, 2004-39290, and 2004-319583. These patent documents show the configuration in which a plurality of series-connected circuits including a plurality of LEDs connected in series are connected in parallel with a constant current supply. This configuration further includes a constant-current circuit and a current mirror circuit with respect to the plurality of series-connected circuits, thereby allowing the same level of current to flow through the LEDs and reducing brightness dispersion among the LEDs.

SUMMARY OF THE INVENTION

To drive LEDs as light sources, the basic technical configuration has been generalized to a certain degree. At the moment, however, this is only in the initial state and is not fully developed. When, for example, the actual usefulness is taken into consideration, reliability and performance can still be improved.

In view of the above-described circumstances, according to an embodiment of the present invention, there is provided a light-emitting diode drive circuit including the following elements: a plurality of series drive circuits each including a predetermined number of light-emitting diodes connected in series; a constant-current circuit operating to output a constant amount of current to, among the plurality of series drive circuits, a series drive circuit serving as a reference, the plurality of series drive circuits being connected in parallel with the current output; a current mirror circuit operable to allow the same amount of current to flow through the plurality of series drive circuits; and a voltage dropping circuit operable to cause a voltage drop of a predetermined level in the series drive circuit serving as the reference, the voltage dropping circuit being disposed in series with the light-emitting diodes forming the series drive circuit serving as the reference.

According to another embodiment of the present invention, there is provided a light source device including the following elements: a plurality of series drive circuits each including a predetermined number of light-emitting diodes connected in series, the light-emitting diodes serving as light sources; a constant-current circuit operating to output a constant amount of current to, among the plurality of series drive circuits, a series drive circuit serving as a reference, the plurality of series drive circuits being connected in parallel with the current output; a current mirror circuit operable to allow the same amount of current to flow through the plurality of series drive circuits; and a voltage dropping circuit operable to cause a voltage drop of a predetermined level in the series drive circuit serving as the reference, the voltage dropping circuit being disposed in series with the light-emitting diodes forming the series drive circuit serving as the reference.

According to another embodiment of the present invention, there is provided a display device including a light source device and an image display panel operable to display an image using light emitted from the light source device. The light source device includes the following elements: a plurality of series drive circuits each including a predetermined number of light-emitting diodes connected in series, the light-emitting diodes serving as light sources; a constant-current circuit operating to output a constant amount of current to, among the plurality of series drive circuits, a series drive circuit serving as a reference, the plurality of series drive circuits being connected in parallel with the current output; a current mirror circuit operable to allow the same amount of current to flow through the plurality of series drive circuits; and a voltage dropping circuit operable to cause a voltage drop of a predetermined level in the series drive circuit serving as the reference, the voltage dropping circuit being disposed in series with the light-emitting diodes forming the series drive circuit serving as the reference.

According to another embodiment of the present invention, there is provided a light-emitting diode drive circuit including the following elements: a plurality of series drive circuits each including a predetermined number of light-emitting diodes connected in series; a constant-current circuit operating to output a constant amount of current to, among the plurality of series drive circuits, a series drive circuit serving as a reference, the plurality of series drive circuits being connected in parallel with the current output; a current mirror circuit operable to allow the same amount of current to flow through the plurality of series drive circuits; and a voltage generating circuit operable to generate, in a current mirror transistor forming the current mirror circuit, which is disposed so that an input terminal and an output terminal of the current mirror transistor are connected in series with the series drive circuit serving as the reference, a certain voltage between the output terminal and a control terminal.

According to another embodiment of the present invention, there is provided a light source device including the following elements: a plurality of series drive circuits each including a predetermined number of light-emitting diodes connected in series, the light-emitting diodes serving as light sources; a constant-current circuit operating to output a constant amount of current to, among the plurality of series drive circuits, a series drive circuit serving as a reference, the plurality of series drive circuits being connected in parallel with the current output; a current mirror circuit operable to allow the same amount of current to flow through the plurality of series drive circuits; and a voltage generating circuit operable to generate, in a current mirror transistor forming the current mirror circuit, which is disposed so that an input terminal and an output terminal of the current mirror transistor are connected in series with the series drive circuit serving as the reference, a certain voltage between the output terminal and a control terminal.

According to another embodiment of the present invention, there is provided a display device including a light source device and an image display panel operable to display an image using light emitted from the light source device. The light source device includes the following elements: a plurality of series drive circuits each including a predetermined number of light-emitting diodes connected in series, the light-emitting diodes serving as light sources; a constant-current circuit operating to output a constant amount of current to, among the plurality of series drive circuits, a series drive circuit serving as a reference, the plurality of series drive circuits being connected in parallel with the current output; a current mirror circuit operable to allow the same amount of current to flow through the plurality of series drive circuits; and a voltage generating circuit operable to generate, in a current mirror transistor forming the current mirror circuit, which is disposed so that an input terminal and an output terminal of the current mirror transistor are connected in series with the series drive circuit serving as the reference, a certain voltage between the output terminal and a control terminal.

When the transistor according to the embodiments of the present invention is a bipolar transistor, the input terminal, the output terminal, and the control terminal of the transistor correspond to the emitter, collector, and base, respectively, of the bipolar transistor. When the transistor according to the embodiments of the present invention is a field-effect transistor (FET), the input terminal, the output terminal, and the control terminal of the transistor correspond to the source, drain, and gate, respectively, of the FET.

According to the above-described configurations, the basic configuration for driving LEDs includes a plurality of series drive circuits each including a predetermined number of LEDs connected in series, and the series drive circuits are connected in parallel with output of a constant-current circuit. The constant-current circuit operates to allow a constant current to flow through, among the plurality of series drive circuits, a series drive circuit serving as a reference. In addition, a current mirror circuit is provided with respect to the plurality of series drive circuits, thereby allowing the same level (amount) of current to flow through the plurality of series drive circuits. As a result, the same amount of current flows through the LEDs, and hence the brightness of light emitted by the LEDs is substantially equal.

Additionally, according to the embodiments of the present invention, a voltage dropping circuit is provided to cause a voltage drop of a predetermined level in the series drive circuit serving as the reference. Alternatively, the voltage dropping circuit is disposed in the series drive circuit serving as the reference to generate a certain voltage between an output terminal and a control terminal of a transistor forming the current mirror circuit. By generating a certain voltage between the output terminal and the control terminal of the transistor, a voltage drop of a predetermined level is caused in the series drive circuit serving as the reference.

According to the embodiments of the present invention, a voltage drop of a predetermined level is caused in the series drive circuit serving as the reference. With this voltage drop, a voltage across the transistor forming the current mirror circuit in each series drive circuit other than the series drive circuit serving as the reference is increased. As a result of increasing the voltage across the transistor, a defective driving state of LEDs owing to differences in voltage drops of the LEDs is removed or alleviated, and the LEDs can be driven more reliably in a more satisfactory manner.

DESCRIPTION OF THE PREFERRED EMBODIMENTS

Prior to the description of preferred embodiments of the present invention, the background of the present invention will be described.

When using LEDs as light sources for an LCD, it is necessary to take into consideration the following points.

First of all, whereas LEDs are substantially point light sources, a display panel of an LCD has a relatively large area. It is thus necessary to provide, as a light source device, the necessary number of LEDs sufficient to ensure the necessary brightness in accordance with the area of the display panel. In other words, depending on the area of the display panel, a very large number of LEDs are necessary. When many LEDs serving as light sources are caused to emit light, it is also demanded that brightness dispersion among the LEDs be reduced within a predetermined range. When the LEDs exhibit brightness dispersion, the brightness of the display panel differs from section to section. As a result, it becomes difficult for the display panel to display a high-quality image.

The brightness of LEDs may be maintained within a predetermined range by, for example, connecting the LEDs in series and allowing a constant current to flow through the LEDs. However, in the case where the number of LEDs is large, such as those serving as light sources for an LCD, when all the LEDs are connected in series and driven, a voltage drop caused by the series-connected circuit becomes very large. It is thus necessary to apply a high drive voltage. This involves a change in the specification of a drive circuit, an increase in the withstand voltage of parts and elements, an increase in the degree of obligation to secure an insulation distance, and the like. Such loads on the circuit become a problem to be taken seriously.

Figure 14:
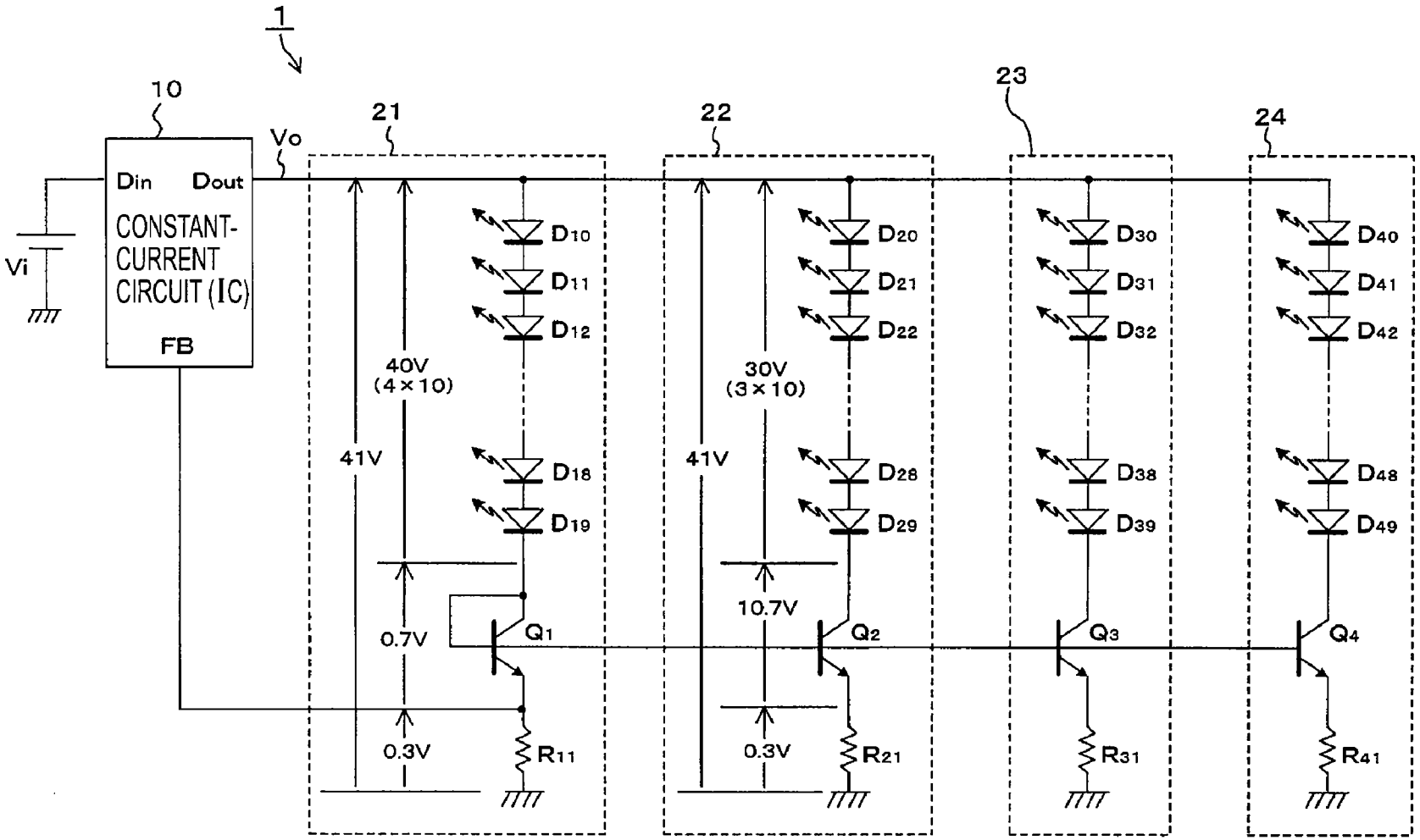
FIG. 14 is a circuit diagram showing an example of the configuration of the LED drive circuit including a combination of a constant-current circuit and the current mirror circuit.

In view of the above, in the case where many LEDs are driven, the LEDs may be divided into groups of an appropriate number of LEDs. The LEDs in each group may be connected in series to configure a series circuit, and the series circuits may be connected in parallel with the constant current output. Accordingly, a voltage drop in each series circuit can be reduced to be less than or equal to a predetermined level in accordance with the number of LEDs in each group. With this configuration, it is necessary to supply the same level of current to each of the LED series circuits connected in parallel. FIG. 14 shows the configuration of an LED drive circuit included in a light source device having LEDs as light sources.

An LED drive circuit 1 shown in FIG. 14 includes a total of 40 LEDs (D10 to D19, D20 to D29, D30 to D39, and D40 to D49) serving as light sources. In this case, the color of light emitted by all the LEDs is white. That is, in FIG. 14, the white LEDs are employed to obtain white light. With the configuration shown in FIG. 14, these 40 LEDs are equally divided into four groups, each group including 10 LEDs, and four LED series circuits are formed. A first series drive circuit 21, a second series drive circuit 22, a third series drive circuit 23, and a fourth series drive circuit 24 shown in FIG. 14 each include one of the four LED series circuits.

The first series drive circuit 21 includes an LED series circuit similarly including 10 LEDs D10 to D19. The LEDs D10 to D19 are connected in series in the same direction, along with the forward direction, in the order of the LEDs D10 to D19.

The second series drive circuit 22 includes an LED series circuit including 10 LEDs D20 to D29, which are connected in the same manner as the LEDs D10 to D19 of the first series drive circuit 21. Similarly, the third series drive circuit 23 includes an LED series circuit including 10 LEDs D30 to D39. The fourth series drive circuit 24 includes an LED series circuit including 10 LEDs D40 to D49.

The anode end (anode of the LED D10) of the LED series circuit of the first series drive circuit 21 is connected to an output terminal Dout of a constant-current circuit 10. Similarly, the anode ends (anodes of the LEDs D20, D30, and D40) of the LED series circuits of the second series drive circuit 22, the third series drive circuit 23, and the fourth series drive circuit 24 are also connected to the output terminal Dout of the constant-current circuit 10.

The cathode end (cathode of the LED D19) of the LED series circuit of the first series drive circuit 21 is connected to the ground via a transistor (collector-emitter) Q1 and an emitter resistor R11. Similarly, the cathode ends (cathodes of the LEDs D29, D39, and D49) of the LED series circuits of the second series drive circuit 22, the third series drive circuit 23, and the fourth series drive circuit 24 are also connected to the ground via a transistor Q2 and an emitter resistor R21, via a transistor Q3 and an emitter resistor R31, and via a transistor Q4 and an emitter resistor R41, respectively.

With such connections, the LED series circuits of the first series drive circuit 21, the second series drive circuit 22, the third series drive circuit 23, and the fourth series drive circuit 24 can be regarded as being connected in parallel with the output terminal Dout of the constant-current circuit 10.

The NPN transistors Q1, Q2, Q3, and Q4 included in the first series drive circuit 21, the second series drive circuit 22, the third series drive circuit 23, and the fourth series drive circuit 24 are provided to form a current mirror circuit with respect to the first series drive circuit 21 as a reference. Thus, standard products of the same type are selected as the transistors Q1, Q2, Q3, and Q4 so as to have equivalent characteristics.

In the first series drive circuit 21, the collector of the transistor Q1 is connected to the cathode end (cathode of the LED D19) of the LED series circuit. The base of the transistor Q1 is connected, in this case, to the collector. Accordingly, the base and the collector of the transistor Q1 are at the same potential. The emitter of the transistor Q1 is connected to one end of the resistor R11. The other end of the resistor R11 is connected to the ground. The node between the emitter resistor R11 and the emitter of the transistor Q1 in the first series drive circuit 21 is connected to a feedback terminal FB of the constant-current circuit.

The collector of the transistor Q2 in the second series drive circuit 22 is connected to the cathode end (cathode of the LED D29) of the LED series circuit, and the emitter is connected to the ground via the emitter resistor R21. Similarly, the collector of the transistor Q3 in the third series drive circuit 23 is connected to the cathode end (cathode of the LED D39) of the LED series circuit, and the emitter is connected to the ground via the emitter resistor R31. The collector of the transistor Q4 in the fourth series drive circuit 24 is connected to the cathode end (cathode of the LED D49) of the LED series circuit, and the emitter is connected to the ground via the emitter resistor R41. It is only necessary to choose the same value for the resistances of the four emitter resistors R11, R12, R13, and R14. Then, the bases of the transistors Q2, Q3, and Q4 are commonly connected to the base of the transistor Q1.

The constant-current circuit 10 includes, in this case, for example, an integrated circuit (IC) for a constant current power supply. The constant-current circuit 10 operates to receive a direct-current power supply Vi at a power supply input terminal Din and, on the basis of a detection level input to a feedback terminal FB, output a constant amount of current from the output terminal Dout. The voltage at the output terminal Dout is denoted by Vo.

In the configuration of the LED drive circuit 1 shown in FIG. 14, the voltage across the resistor R11 in the first series drive circuit 21 is input to the feedback terminal FB of the constant-current circuit 10. More specifically, the voltage level corresponding to the amount of current flowing through the first series drive circuit 21 is input to the feedback terminal FB of the constant-current circuit 10. On the basis of the voltage level input to the feedback terminal FB, the constant-current circuit 10 detects an error based on a predetermined constant current level and varies the current level (current amount) to be output from the output terminal Dout so that the error becomes zero. Accordingly, the constant-current circuit 10 operates with respect to the first series drive circuit 21 so that the amount of current flowing through the first series drive circuit 21 is constant.

Then, in the configuration shown in FIG. 14, according to the above-described circuit configuration, the current mirror circuit including the transistors Q1, Q2, Q3, and Q4 is formed. The current mirror circuit arranged in this manner operates, as if following the transistor Q1, to make the base potentials of the transistors Q2, Q3, and Q4 equal to that of the transistor Q1. In order to do so, the transistors Q2, Q3, and Q4 perform amplification using the same amount of base current as that of the transistor Q1, thereby allowing the collector current at the same level as that of the transistor Q1 to flow through the transistors Q2, Q3, and Q4. As a result, with respect to the first series drive circuit 21 serving as the reference, the same amount of current flows through the second series drive circuit 22, the third series drive circuit 23, and the fourth series drive circuit 24.

In the LED drive circuit 1, the constant-current circuit 10 operates with respect to the first series drive circuit 21 so that the constant amount of current is constantly allowed to flow through the first series drive circuit 21. In addition, with the current mirror circuit, the same amount of current as that flowing through the first series drive circuit 21 serving as the reference is also allowed to flow through the second series drive circuit 22, the third series drive circuit 23, and the fourth series drive circuit 24.

This means that, with respect to the LED series circuit (D10 to D19) of the first series drive circuit 21 serving as the reference, the constant current is allowed to flow through the LED series circuit of the first series drive circuit 21, and then the same amount of current as that flowing through the LED series circuit of the first series drive circuit 21 is allowed to flow through the LED series circuits (D20 to D29, D30 to D39, and D40 to D49) of the remaining second series drive circuit 22, the third series drive circuit 23, and the fourth series drive circuit 24. As a result, the current level flowing through the 40 LEDs (D10 to D19, D20 to D29, D30 to D39, and D40 to D49) included in the overall LED drive circuit 1 becomes equal, and dispersion of brightness of light emitted by the LEDs is removed or reduced, and the brightness of light emitted by the LEDs becomes constant.

In the circuit shown in FIG. 14, the LED series circuits are connected in parallel with the constant current output, thereby avoiding a problem of high voltage driving. With the combination of the constant-current circuit and the current mirror circuit, the amount of current allowed to flow through each LED is made equal. Alternatively, each of the LED series circuits (series drive circuits) connected in parallel may be provided with a constant-current circuit to maintain the amount of current allowed to flow through each LED to be constant. However, it is necessary in this case to provide the same number of constant-current circuits as that of the LED series circuits (series drive circuits), and this involves an increase in the circuit size and cost. As shown in FIG. 14, it is advantageous in terms of the circuit size and cost to combine one constant-current circuit with the current mirror circuit. The current mirror circuit has, for example, as shown in FIG. 14, a simple circuit configuration including one transistor and one emitter resistor for each LED series circuit (series drive circuit).

Actually, however, the LED drive circuit 1 shown in FIG. 14 is inconvenient in the following ways.

As is commonly known, there is a forward-direction voltage drop Vf across an LED. An average forward-direction voltage drop is about 3.5 V. However, the value 3.5 V is only an average. It is known that actual LEDs have forward-direction voltage drops ranging from about 3.0 V to 4.0 V.

To simplify the description, the LED drive circuit 1 is configured on the assumption that the lower limit of the dispersion of forward-direction voltage drops across LEDs is 3.0 V, and the upper limit thereof is 4.0 V. Since each LED series circuit in the LED drive circuit 1 has 10 LEDs, the lower limit of the forward-direction voltage drops in each LED series circuit is 30 V (3.0×10) and the upper limit thereof is 40 V (4.0×10). That is, when actually configuring the LED drive circuit 1, the voltage drop in each LED series circuit may vary within a range of 30 V to 40 V.

FIG. 14 shows, as the case of different voltage drops of 30 V and 40 V, which are the lower limit and the upper limit, respectively, of the voltage drop in one LED series circuit, the case in which the LED series circuit of the first series drive circuit 21 serving as the reference has a voltage drop of 40 V, and the LED series circuit of the second series drive circuit 22 following the first series drive circuit 21 has a voltage drop of 30 V.

In this case, as described above, the voltage drop in the LED series circuit of the first series drive circuit 21 is 40 V. Since the base of the transistor Q1 is connected to the collector, the collector potential of the transistor Q1 is the same as the base potential. On the assumption that the base-emitter voltage (VBE1) of the transistor Q1 is 0.7 V, the collector-emitter voltage (VCE1) of the transistor Q1 is also 0.7 V. The resistance of the emitter resistor R11 is selected so that the emitter potential corresponding to the voltage across the emitter resistor R11 is 0.3 V.

In the overall first series drive circuit 21, there are voltage drops of 40 V, 0.7 V, and 0.3 V. The voltage applied across the entire first series drive circuit 21, i.e., the voltage Vo generated at the output terminal Dout of the constant-current circuit 10, is:

$$Vo=41\text{ V }(=40\text{ V}+0.7\text{ V}+0.3\text{ V})$$

The voltage Vo=41 V is also applied across the second series drive circuit 22 following the first series drive circuit 21. The voltage drop in the LED series circuit of the second series drive circuit 22 is 30 V.

Since the base of the transistor Q2 is connected to the base of the transistor Q1 and hence they are at the same potential, the emitter potential (voltage across the resistor R21) is 0.3 V, which is the same as that in the first series drive circuit 21. In this state, the collector-emitter voltage (VCE2) of the transistor Q2 is VCE2=10.7 V (=41 V−(30 V+0.3 V)).

In this case, whereas the collector voltage and the base voltage of the transistor Q1 are 1 V (=0.7 V+0.3 V), the collector voltage of the transistor Q2 is 11 V (=10.7 V+0.3 V). The transistor Q2 thus satisfies a condition for normal operation in an unsaturated region. That is, the current mirror circuit operates normally, and hence there is no particular problem.

Figure 15:
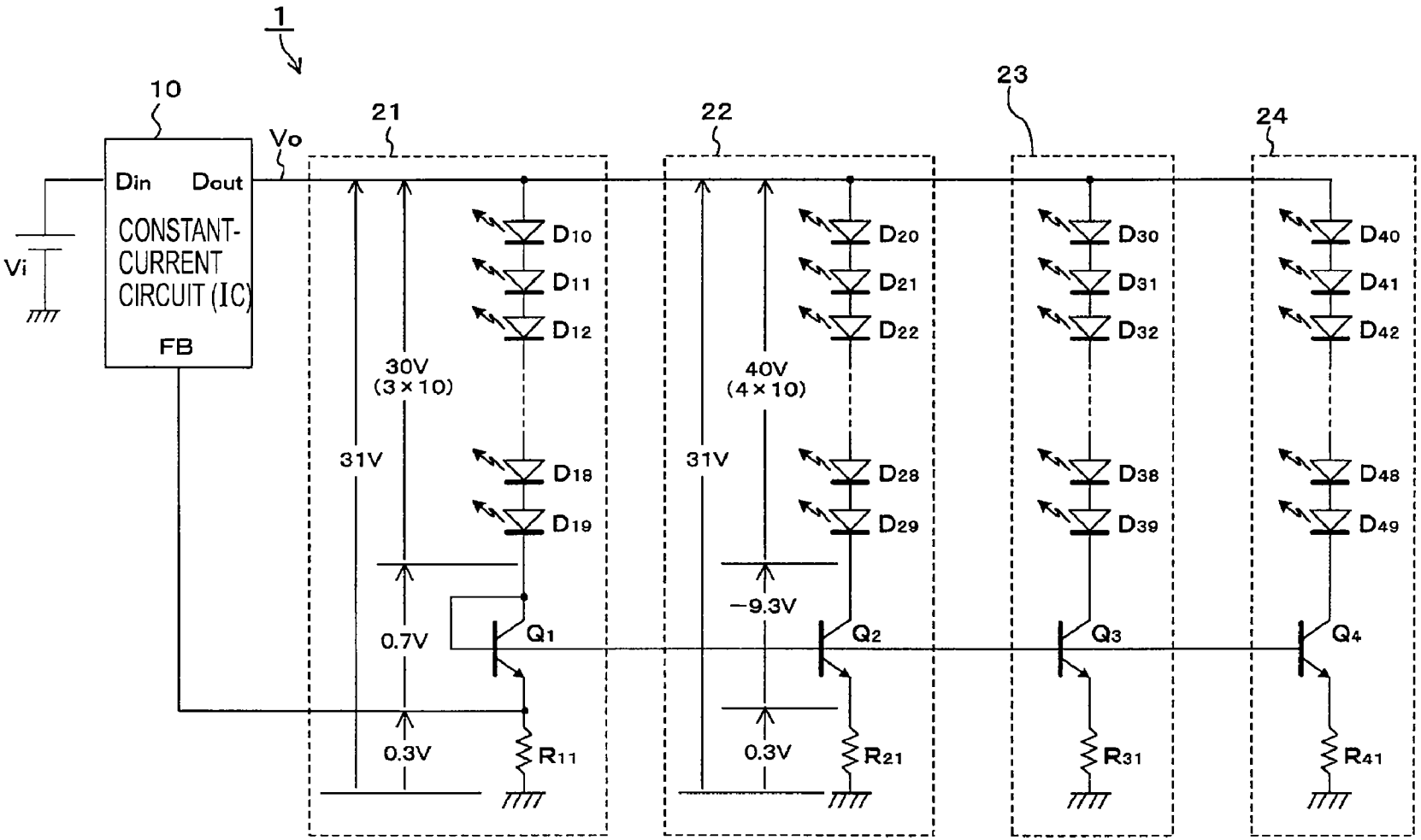
FIG. 15 is a circuit diagram showing the operation of the LED drive circuit shown in FIG. 14 under a specific condition of LED voltage drop dispersion.

In contrast, opposite to the case in FIG. 14, FIG. 15 shows, as the case of different voltage drops of 30 V and 40 V, which are the minimum value and the maximum value, respectively, of the voltage drop in one LED series circuit, the case in which the voltage drop in the LED series circuit of the first series drive circuit 21 serving as the reference is 30 V and the voltage drop in the LED series circuit of the second series drive circuit 22 is 40 V.

In the first series drive circuit 21 in this case, there are a voltage drop of 30 V in the LED series circuit, a voltage drop of 0.7 V serving as the base-emitter voltage (VBE1) and the collector-emitter voltage (VCE1) of the transistor Q1, and a voltage drop of 0.3 V serving as the emitter voltage (voltage across the emitter resistor R11). Therefore, the voltage Vo applied across the entire first series drive circuit 21 is Vo=31 V (=30 V+0.7 V+0.3 V).

The voltage Vo=31 V is also applied across the second series drive circuit 22 following the first series drive circuit 21.

In this case, however, the voltage drop in the LED series circuit of the second series drive circuit 22 is 40 V. The emitter voltage (voltage across the resistor R21) of the transistor Q2 is 0.3 V, which is the same as that in the first series drive circuit 21. In this case, the collector-emitter voltage (VCE2) of the transistor Q2 is −9.3 V (=31 V−(40 V+0.3 V)). That is, the collector-emitter voltage in this case is computationally a negative value. In such a potential state, it is difficult for the transistor Q2 to operate normally in an unsaturated region. In this case, it becomes difficult for the current mirror circuit to operate normally and it thus becomes difficult to allow the same amount of current as that flowing through the first series drive circuit 21 to flow through, for example, the second series drive circuit 22.

As shown in FIG. 14 (FIG. 15), the LED drive circuit including a simple combination of the constant-current circuit and the current mirror circuit has a problem in practical application in that the normal operation may not be ensured when the dispersion of forward-direction voltage drops across the actual LEDs is taken into consideration.

According to the preferred embodiments of the present invention, there is provided the LED drive circuit 1 in which the above-described dispersion of forward-direction voltage drops across the actual LEDs is absorbed and the normal current mirror circuit operation is achieved.

Figure 1:
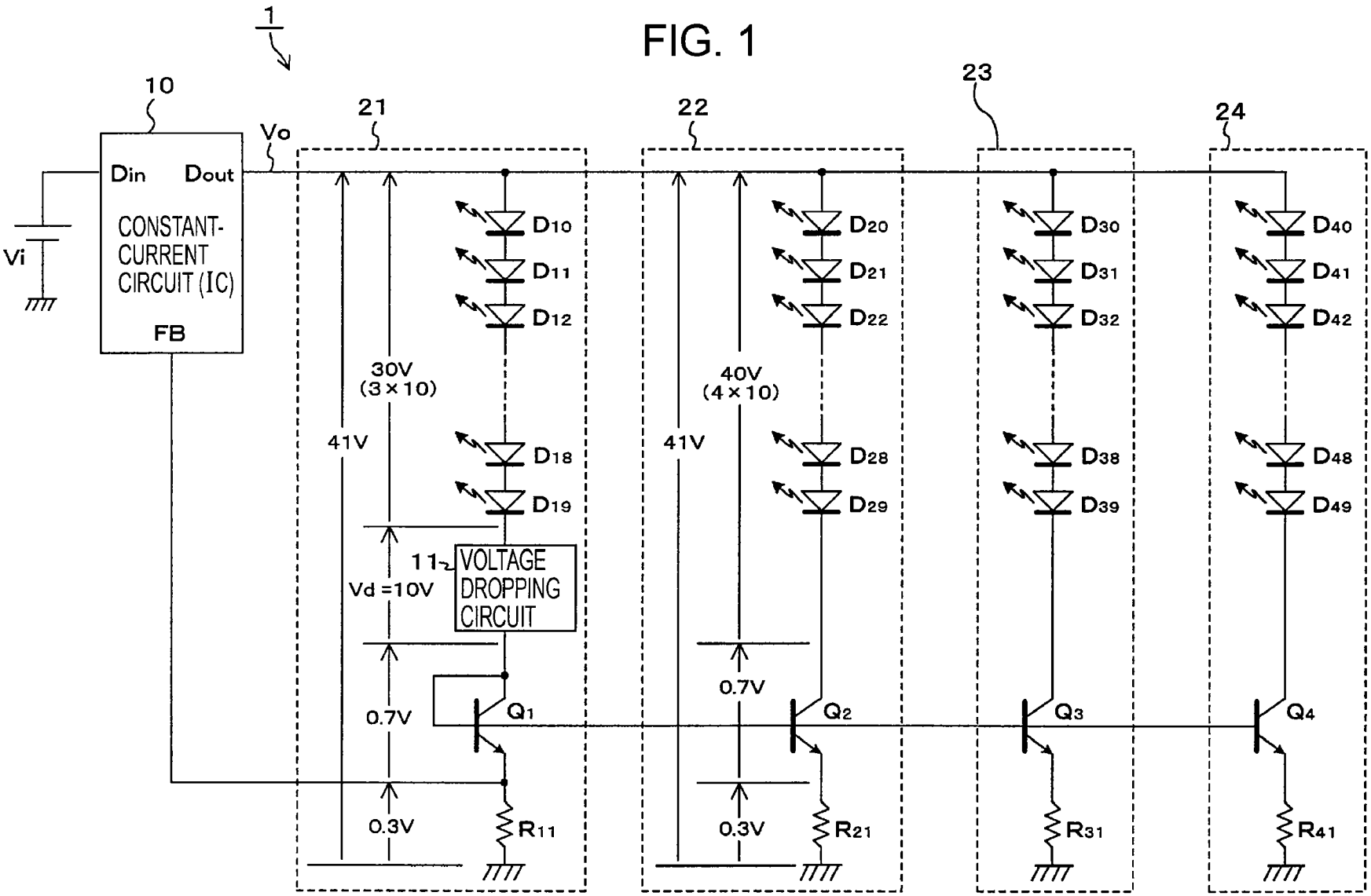
FIG. 1 is a circuit diagram showing an example of the configuration of an LED drive circuit according to a first embodiment of the present invention.

FIG. 1 shows an example of the configuration of the LED drive circuit 1 according to a first embodiment of the present invention. In FIG. 1, the same parts as those in FIGS. 14 and 15 are designated by the same reference numerals, and repeated descriptions thereof will be omitted.

The configuration of the LED drive circuit 1 shown in FIG. 1 is the same as those shown in FIGS. 14 and 15 except for a voltage dropping circuit 11 included in the first series drive circuit 21. More specifically, the basic configuration of the LED drive circuit 1 includes the first to fourth series drive circuits 21 to 24 each including 10 series-connected LEDs, which are connected in parallel with the output of the constant-current circuit 10. The constant-current circuit 10 operates to allow a predetermined constant amount of current to flow through the first series drive circuit 21 serving as the reference on the basis of the amount of current detected by the detection resistor R11 in the first series drive circuit 21. Also, the current mirror circuit is formed by providing the first to fourth series drive circuits 21 to 24 with the associated transistors Q1 to Q4, thereby allowing the same amount of current as that flowing through the first series drive circuit 21 to flow through the second to fourth series drive circuits 22 to 24.

Then, in the LED drive circuit 1 shown in FIG. 1, the voltage dropping circuit 11 is disposed in series with the LED series circuit (D10 to D19) of the first series drive circuit 21. The position at which the voltage dropping circuit 11 is disposed in this case is the line between the cathode end of the LED D19 in the LED series circuit (D10 to D19) and the collector of the transistor Q1. The voltage dropping circuit 11 is provided to cause a voltage drop (voltage drop Vd) of a predetermined level in the first series drive circuit 21.

Figure 2:
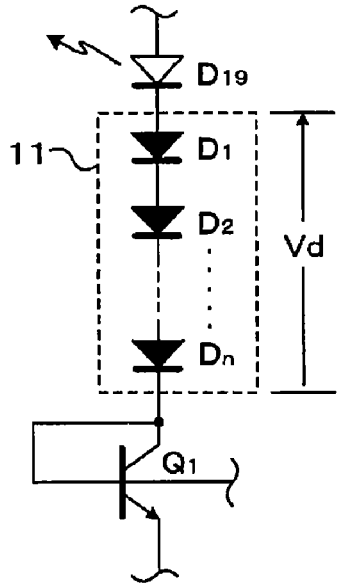
FIG. 2 is a circuit diagram showing a modification of the configuration of a voltage dropping circuit according to the first embodiment.

To make the description easier to understand, an example of the configuration of the voltage dropping circuit 11 is shown in FIG. 2. The remaining parts of the configuration will be described later.

The voltage dropping circuit 11 shown in FIG. 2 is formed by connecting a predetermined number of diodes D1 to Dn in series in accordance with the same forward direction as that of the LED series circuit. In this case, the number of diodes included in the voltage dropping circuit 11 is one or greater, and the number of diodes in accordance with the actual necessary voltage drop Vd may be provided and connected in series. In FIG. 2, the diodes function as voltage dropping elements. Since each diode has a forward-direction voltage drop of about 0.65 V, the voltage drop Vd expressed as Vd=0.65 V×n in accordance with the number of diodes D1 to Dn can be caused.

The operation of the LED drive circuit 1 including the voltage dropping circuit 11 configured, for example, as above will be described.

In the description, the voltage drop caused by the LED series circuit (D10 to D19) of the first series drive circuit 21 is 30 V, which is the lower limit of the dispersion. The voltage drop caused by the LED series circuit (D20 to D29) of the second series drive circuit 22 is 40 V, which is the upper limit of the dispersion. In other words, the relationship between the voltage drop levels of the LED series circuit (D10 to D19) of the first series drive circuit 21 and the LED series circuit (D20 to D29) of the second series drive circuit 22 is the same as that shown in FIG. 15. For the sake of confirmation, with this dispersion combination in the circuit configuration shown in FIG. 15, the collector voltage of the transistor Q2 in the second series drive circuit 22 becomes abnormal, and it thus becomes difficult to expect the appropriate current mirror circuit operation.

It is assumed that the voltage drop Vd caused by the voltage dropping circuit 11 is 10 V. For example, when the voltage dropping circuit 11 includes the diodes shown in FIG. 2, the voltage drop Vd is not exactly 10 V since each diode has a forward-direction voltage drop of about 0.65 V. However, the description is simplified by setting the voltage drop Vd to 10 V.

In the first series drive circuit 21 in this case, in addition to a voltage drop of 30 V in the LED series circuit, a voltage drop of 0.7 V serving as the base-emitter voltage (VBE1) and the collector-emitter voltage (VCE1) of the transistor Q1, and a voltage drop of 0.3 V serving as the emitter voltage (voltage across the emitter resistor R11), there is a voltage drop of 10 V caused by the voltage dropping circuit 11. Therefore, the voltage Vo applied across the entire first series drive circuit 21 is expressed by Vo=41 V (=30 V+0.7 V+0.3 V+10 V).

The voltage Vo=41 V is also applied across the second series drive circuit 22.

Consequently, the collector-emitter voltage (VCE2) of the transistor Q2 in the second series drive circuit 22 is computed as follows. Specifically, since the LED series circuit (D20 to D29) has a voltage drop of 40 V and the emitter resistor R21 has a voltage drop of 0.3 V, VCE2=0.7 V (=41 V−(40 V+0.3 V)).

In contrast to the case in which the collector voltage of the transistor Q1 in the first series drive circuit 21 in this case is 1 V (=0.7 V+0.3 V), the collector voltage of the transistor Q2 in the second series drive circuit 22 is also 1 V (=0.7 V+0.3 V). That is, the collector voltages of the transistors Q1 and Q2 are equal. This means that the current mirror circuit operates normally and that the same amount of current as that flowing through the first series drive circuit 21 is allowed to flow through the second series drive circuit 22. When the voltage drop in the LED series circuit of, instead of the second series drive circuit 22, the third series drive circuit 23 is 40 V, the same voltage drop state as described above is generated. The collector voltages of the transistors Q1 and Q3 become equal, and the normal current mirror circuit operation is achieved. In the LED drive circuit 1 according to the first embodiment of the present invention, even in the case of different voltage drops, that is, the voltage drop in the LED series circuit of the first series drive circuit 21 serving as the reference is small, whereas the voltage drop in the LED series circuit in any of the second series drive circuit 22, the third series drive circuit 23, and the fourth series drive circuit 24 following the first series drive circuit 21 is large, the normal operation of the current mirror circuit can be maintained.

Figure 3:
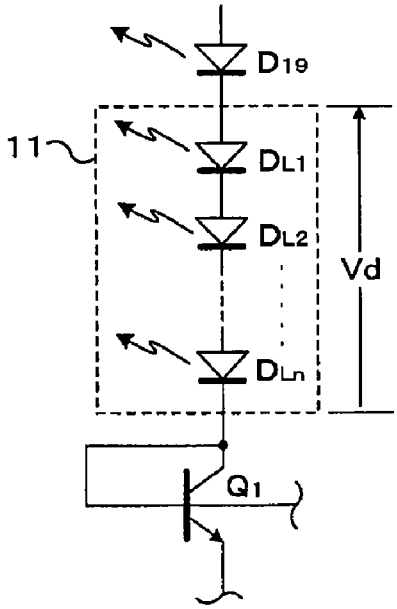
FIG. 3 is a circuit diagram showing a modification of the configuration of the voltage dropping circuit according to the first embodiment.
Figure 4:
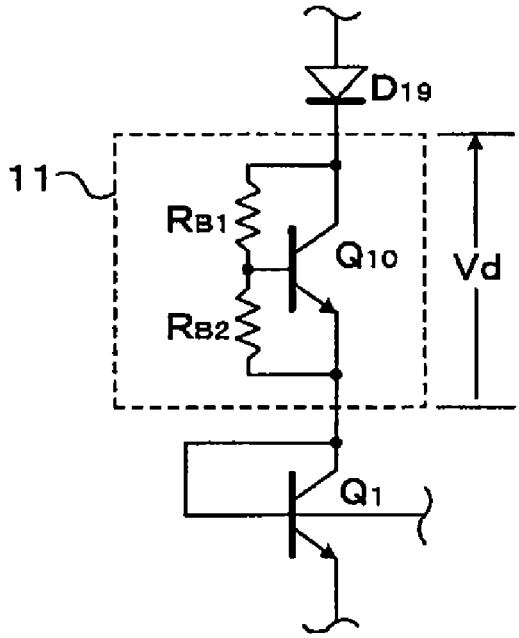
FIG. 4 is a circuit diagram showing a modification of the configuration of the voltage dropping circuit according to the first embodiment.
Figure 5:
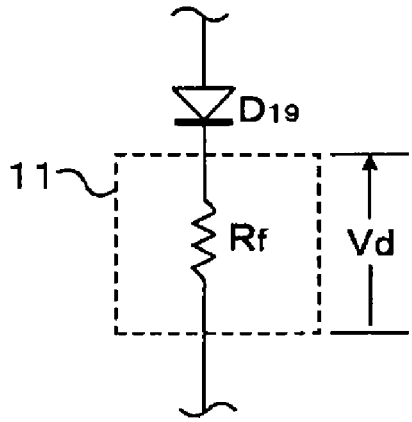
FIG. 5 is a circuit diagram showing a modification of the configuration of the voltage dropping circuit according to the first embodiment.

FIGS. 3 to 5 show examples of the configuration of the voltage dropping circuit 11, other than that shown in FIG. 2.

In FIG. 3, LEDs are used as voltage dropping elements. The necessary number of LEDs (DL1 to DLn) are connected in series in accordance with the same forward direction as that of the LED series circuit, thereby forming the voltage dropping circuit 11. Also in this case, the number of LEDs included in the voltage dropping circuit 11 is one or greater, and the number of LEDs in accordance with the actual necessary voltage drop Vd may be provided and connected in series. Generally, each LED has a forward-direction voltage drop of about 3.2 V to 3.6 V.

FIG. 4 shows the configuration of the voltage dropping circuit 11 with a simple constant-voltage circuit including one transistor Q10. The transistor Q10 in this case is NPN. The collector is connected to the cathode of the diode D19, and the emitter is connected to the collector of the transistor Q1. A resistor RB1 is connected between the collector and the base of the transistor Q10, and a resistor RB2 is connected between the base and the emitter of the transistor Q10.

With this configuration, the base-emitter voltage (VBE10) of the NPN transistor Q10 is about 0.6 V to 0.7 V. When VBE10 is 0.6 V, the collector-emitter voltage (VCE10) of the transistor Q10 has a certain level expressed as:

$$VCE10=0.6\text{ V}\times(RB1+RB2)/RB2 \quad (1)$$

That is, the certain voltage level serving as the collector-emitter voltage (VCE10) of the transistor Q10 can be variously set to an arbitrary value depending on the resistances of the resistors RB1 and RB2. With the configuration shown in FIG. 4, the collector-emitter voltage (VCE10) of the transistor Q10 set as above serves as the voltage drop Vd.

The voltage dropping circuit 11 shown in FIG. 5 includes, as a voltage dropping element, a resistance element Rf having a resistance necessary to achieve the voltage drop Vd.

For example, in the voltage dropping circuit 11 shown in FIG. 3, when the drive current flows from the line of the voltage Vo to the first series drive circuit 21, as a matter of course, the LEDs (DL1 to DLn) in a region serving as the voltage dropping circuit 11 are also driven to emit light. Therefore, as shown in FIG. 3, when LEDs are employed as voltage dropping elements included in the voltage dropping circuit 11, similarly as in the LEDs (D10 to D19) serving as the original light sources, the LEDs serving as the voltage dropping elements can also be effectively used as light sources.

Each LED has a forward-direction voltage drop of about 3.2 V to 3.6 V. When each LED has a forward-direction voltage drop of 3.5 V, the voltage drop increases in steps of about 3.5 V, such as 3.5 V, 7 V, and 10.5 V, as the number of series-connected LEDs increases. Accordingly, the voltage drop changes in steps of about 3.5 V are relatively large, when it is taken into consideration that the actual drive voltage for the constant-current circuit 10 is on the order of several tens of V. Therefore, depending on the actually set drive voltage, it may be difficult to appropriately adjust the voltage drop Vd with the voltage drop changes in steps of about 3.5 V.

In contrast, with the configuration including the series-connected diodes shown in FIG. 2, each diode has a forward-direction voltage drop of about 0.65 V, which is significantly smaller than that of an LED. Therefore, finer adjustment of the voltage drop Vd can be performed.

In the configuration of the voltage dropping circuit 11 shown in FIG. 2 or FIG. 3 in which the plural diodes or the plural LEDs are connected in series, if for any reason it is desirable to reduce the voltage drop Vd, the necessary number of diodes or LEDs may be removed, which involves only a simple operation.

In the configuration of the voltage dropping circuit 11 including the constant-voltage circuit shown in FIG. 4, the voltage drop Vd can be adjusted in almost linear steps by changing the resistors RB1 and RB2.

The configuration including the resistance element Rf shown in FIG. 5 is the simplest of all the shown configurations of the voltage dropping circuit 11 and thus has an advantage in terms of, for example, costs of parts.

The voltage dropping circuit 11 may be configured by including all or some of the voltage dropping elements and the circuits shown in FIGS. 2 to 5. For example, the voltage dropping circuit 11 may include a series-connected circuit having a mixture of diodes shown in FIG. 2 and LEDs shown in FIG. 3.

Figure 6:
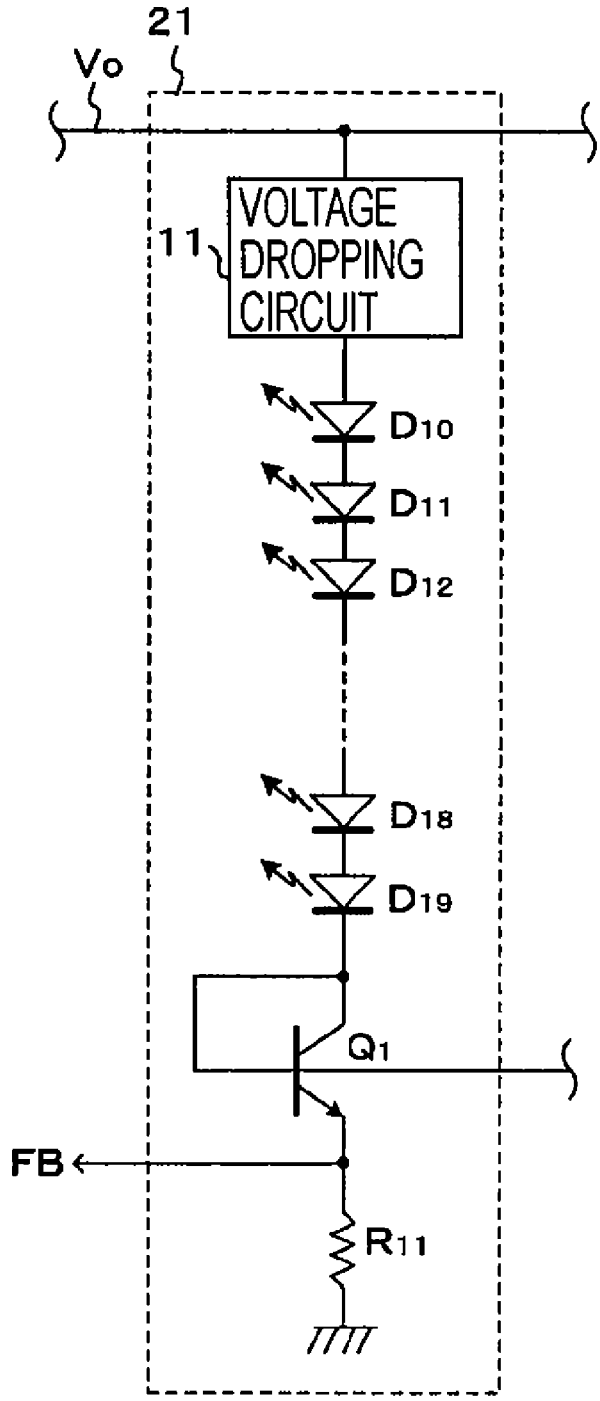
FIG. 6 is a circuit diagram showing a modification of the position at which the voltage dropping circuit according to the first embodiment is disposed.

FIG. 6 shows a modification of the position at which the voltage dropping circuit 11 according to the first embodiment is disposed. Although only the first series drive circuit 21 is shown in FIG. 6, the remaining parts are the same as those shown in FIG. 1.

Referring to FIG. 6, in the first series drive circuit 21, the voltage dropping circuit 11 is disposed between the line of the voltage Vo and the anode of the LED D10, which corresponds to the anode end of the LED series circuit. For the sake of confirmation, the configuration of the voltage dropping circuit 11 may be any of those shown in FIGS. 2, 3, 4, and 5.

When the voltage dropping circuit 11 is disposed at this position, the voltage Vo is increased due to the voltage drop caused by the voltage dropping circuit 11, and, as a result, the collector voltages of the transistors Q2, Q3, and Q4 of the second to fourth series drive circuits 22 to 24 following the first series drive circuit 21 are increased. As in the case of FIG. 1, the appropriate current mirror circuit operation can be achieved.

Although omitted in the drawings, the voltage dropping circuit 11 may be disposed, for example, between the anode and the cathode of arbitrary LEDs of the LED series circuit (D10 to D19). The actual position at which the voltage dropping circuit 11 is disposed can be determined in accordance with, for example, the physical configuration of LEDs and circuits of a light source device including the LED drive circuit 1 according to the first embodiment.

Figure 7:
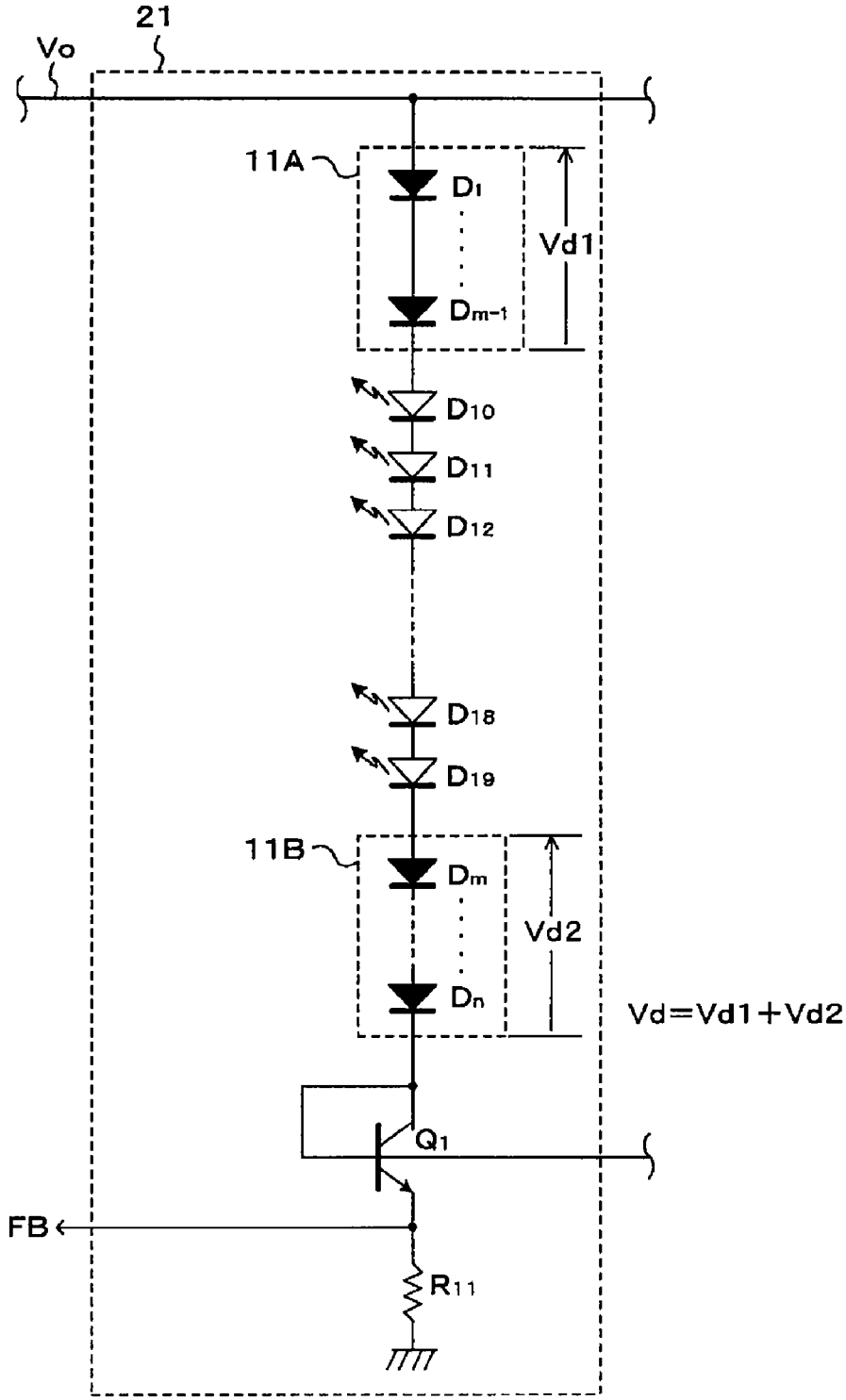
FIG. 7 is a circuit diagram showing a modification of the position at which the voltage dropping circuit according to the first embodiment is disposed.

FIG. 7 shows another modification of the position at which the voltage drop circuit 11 according to the first embodiment is disposed. Although only the first series drive circuit 21 is shown in FIG. 7, as in FIG. 6, the remaining parts are the same as those shown in FIG. 1.

Referring to FIG. 7, the voltage dropping circuit 11 is divided into separate voltage dropping circuits 11A and 11B. These separate voltage dropping circuits 11A and 11B are disposed at different positions in the first series drive circuit 21. In FIG. 7, the separate voltage dropping circuit 11A is disposed between the line of the voltage Vo and the anode of the LED D10, which serves as the anode end of the LED series circuit, and the separate voltage dropping circuit 11B is disposed between the cathode of the LED D19, which serves as the cathode end of the LED series circuit, and the collector of the transistor Q1.

A voltage drop caused by the separate voltage dropping circuit 11A is denoted by Vd1, and a voltage drop caused by the separate voltage dropping circuit 11B is denoted by Vd2. The total voltage drop Vd caused by the voltage dropping circuit 11 necessary in the first series drive circuit 21 is expressed as Vd=Vd1+Vd2.

FIG. 7 shows the case in which the separate voltage dropping circuits 11A and 11B each include, as has been described using FIG. 2, a series-connected circuit including series-connected diodes (the number of diodes may be one or greater) as voltage dropping elements. The separate voltage dropping circuit 11A includes a predetermined number of diodes D1 to Dm-1 connected in series, the number of which corresponds to the voltage drop Vd1. Similarly, the separate voltage dropping circuit 11B includes a predetermined number of diodes Dm to Dn connected in series, the number of which corresponds to the voltage drop Vd2.

In this case, the voltage drops Vd1 and Vd2 actually set by the separate voltage dropping circuits 11A and 11B are not necessarily the same. In other words, as shown in FIG. 7, when diodes are used as voltage dropping elements, the separate voltage dropping circuits 11A and 11B may have different numbers of diodes connected in series.

The number of separate voltage dropping circuits is not limited to two. Alternatively, the voltage dropping circuit 11 may be divided into three or more separate voltage dropping circuits, which may be disposed at arbitrary positions in the first series drive circuit 21 at which the drive current is allowed to flow.

Although FIG. 7 shows the configuration in which the separate voltage dropping circuits 11A and 11B include diodes, the configuration including, for example, LEDs shown in FIG. 3 may be employed. Alternatively, the configurations shown in FIGS. 4 and 5 may be employed.

When the configuration shown in FIG. 4 is employed, the separate voltage dropping circuits each include the transistor Q10 and the resistors RB1 and RB2, as shown in FIG. 4. Additionally, the resistors RB1 and RB2 are selected so as to cause the voltage drops (Vd1, Vd2, . . . ) necessary in the associated separate voltage dropping circuits.

When the configuration shown in FIG. 4 is employed, the resistors with resistances corresponding to the voltage drops (Vd1, Vd2, . . . ) necessary in the associated separate voltage dropping circuits may be selected and disposed.

Figure 8:
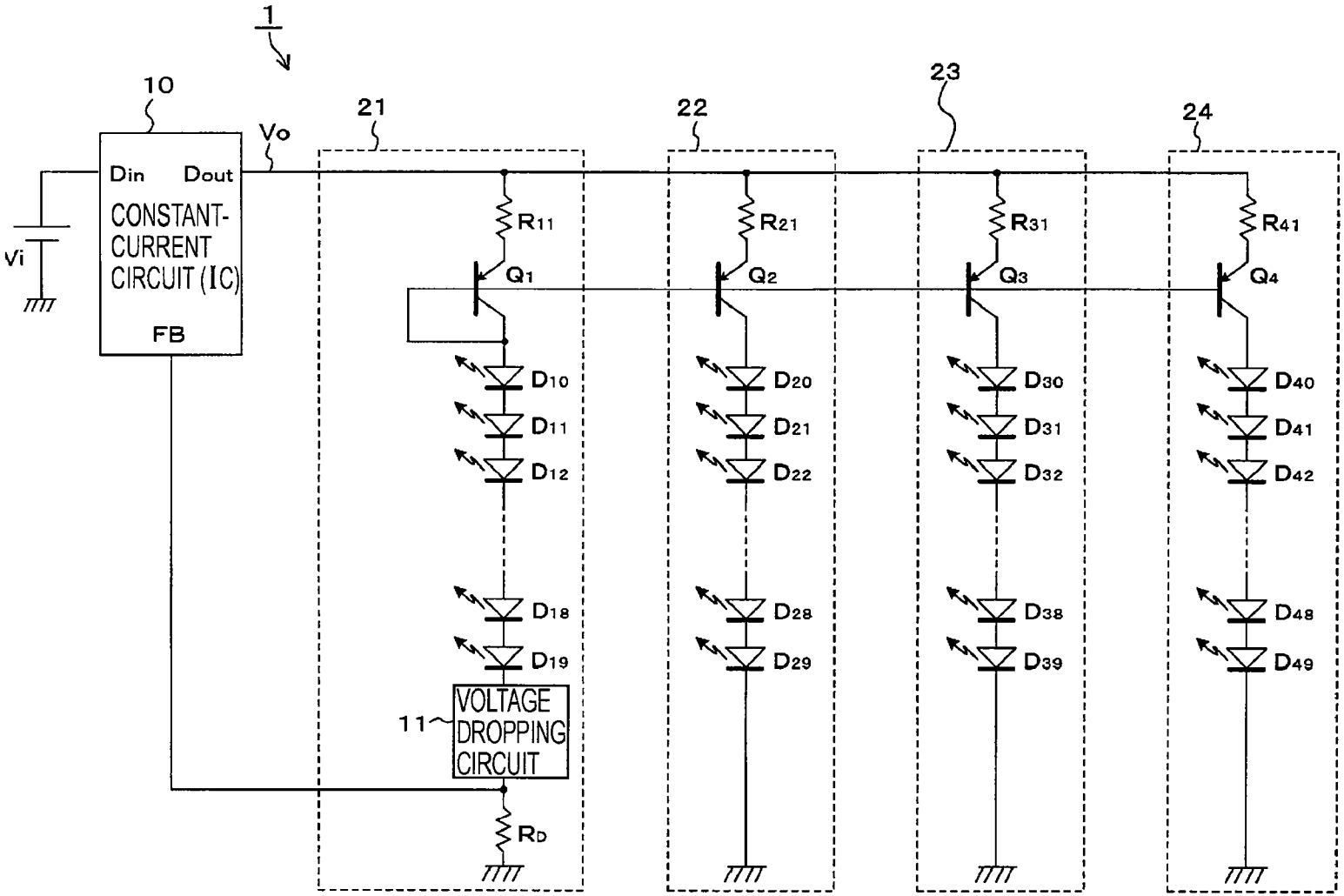
FIG. 8 is a circuit diagram showing a modification of the circuit configuration of a current mirror circuit according to the first embodiment.

FIG. 8 shows a modification of the circuit configuration of the current mirror circuit according to the first embodiment. In FIG. 8, the same parts as those in FIG. 1 are designated by the same reference numerals, and repeated descriptions thereof will be omitted.

Referring to FIG. 8, the transistors Q1, Q2, Q3, and Q4 forming the current mirror circuit are PNP. In the first series drive circuit 21, for example, the emitter of the transistor Q1 is connected to the line of the voltage Vo via the emitter resistor R11, and the collector is connected to the anode end (anode of D10) of the LED series circuit (D10 to D19).

In the second, third, and fourth series drive circuits 22, 23, and 24, the transistors Q2, Q3, and Q4 are connected in the same manner as in the first series drive circuit 21. Then, the bases of the transistors Q1, Q2, Q3, and Q4 are connected to one another.

In this case, because the emitter resistor R11 of the transistor Q1 is connected to the line of the voltage Vo and is not connected to ground, it is difficult to use, as in the case of FIG. 1, the voltage across the emitter resistor R11 as a detection voltage to be input to the feedback terminal FB of the constant-current circuit 10. In this case, a detection resistor Rd is additionally disposed between the voltage dropping circuit 11 and the ground. The amount of drive current is detected as the voltage across the detection resistor Rd and is input to the feedback terminal FB of the constant-current circuit 10.

With this configuration, the first to fourth series drive circuits 21 to 24 are connected in parallel with the line of the voltage Vo, which is the output of the constant-current circuit 10. In addition, the current mirror circuit including the PNP transistors Q1, Q2, Q3, and Q4 is formed with respect to the first to fourth series drive circuits 21 to 24.

Even with this configuration, since the voltage dropping circuit 11 in which the appropriate voltage drop Vd is set is disposed in the first series drive circuit 21, although the voltage drop in the LED series circuit of the first series drive circuit 21 is smaller than those of the other series drive circuits, the collector voltages of the transistors Q2, Q3, and Q4 are maintained within an appropriate range, and the normal current mirror circuit operation can be achieved.

With this configuration, the detection resistor Rd can also cause a voltage drop in accordance with the resistance. The voltage drop caused by the detection resistor Rd is also included in the voltage drop Vd caused by the voltage dropping circuit 11. Since the voltage drop caused by the detection resistor Rd is included in the voltage drop Vd, the burden on the voltage dropping circuit 11 to generate a voltage drop is reduced. Also, the voltage drop Vd can be adjusted in a finer manner.

A second embodiment of the present invention will now be described. Prior to the description of the configuration of the second embodiment, referring to FIG. 9, the operation of the LED drive circuit 1 according to the first embodiment shown in FIG. 1 under the following conditions will be examined.

Figure 9:
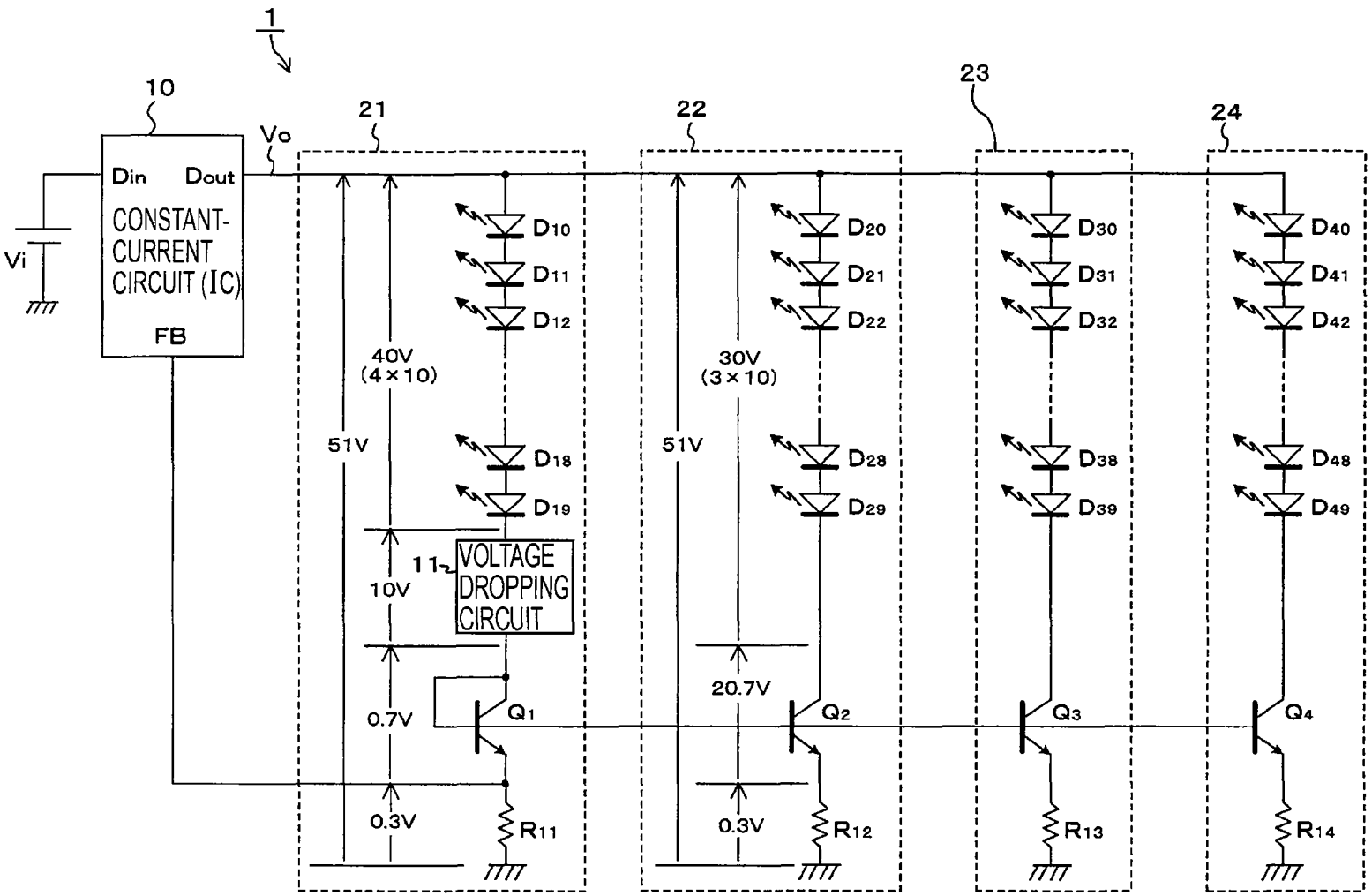
FIG. 9 is a circuit diagram showing the operation of the LED drive circuit according to the first embodiment under a specific condition of LED voltage drop dispersion.

In FIG. 9, the following conditions are assumed: the dispersion of voltage drops across LEDs is within a range of 3.0 V to 4.0 V; the overall voltage drop caused by the LED series circuit (D10 to D19) of the first series drive circuit 21 is 40 V (=4.0 V×10), which is the upper limit of the dispersion range, whereas the overall voltage drop caused by the LED series circuit (D20 to D29) of the second series drive circuit 22 is 30 V (=3.0 V×10), which is the lower limit of the dispersion range; and voltage drops caused by the voltage dropping circuit 11, the transistor Q1, and the emitter resistor R11 are the same as those in the case of FIG. 1.

In the first series drive circuit 21, there are a voltage drop of 40 V caused by the LED series circuit (D10 to D19), a voltage drop of 10 V caused by the voltage dropping circuit 11, a voltage drop of 0.7 V serving as the collector-emitter voltage (VCE1) of the transistor Q1, and a voltage drop of 0.3 V caused by the emitter resistor R11. The voltage Vo applied to the first series drive circuit 21 is thus:

$$Vo=51\text{ V }(=40\text{ V}+10\text{ V}+0.7\text{ V}+0.3\text{ V}).$$

Accordingly, the collector-emitter voltage (VCE2) of the transistor Q2 in the second series drive circuit 22 is:

$$VCE2=20.7\text{ V }(=51\text{ V}-(30\text{ V}+0.3\text{ V}))$$

Whereas the collector-emitter voltage (VCE1) of the transistor Q1 in the first series drive circuit 21 is 0.7 V, the collector-emitter voltage (VCE2) of the transistor Q2 in the second series drive circuit 22 is 20.7 V.

The collector-emitter voltage (VCE2) of the transistor Q2 satisfies, for example, the condition that it is equal to or greater than the collector-emitter voltage (VCE1) of the transistor R1. Therefore, the transistor Q2 operates normally in an unsaturated region, and the current mirror circuit operates normally.

There is a considerable difference between the collector-emitter voltage (VCE1=0.7 V) of the transistor Q1 and the collector-emitter voltage (VCE2=20.7 V) of the transistor Q2.

Bipolar transistors are such that, even with the same amount of base current, the higher the collector-emitter voltage (VCE), the more the collector current increases, which is known as VCE-Ic characteristics. In the case of the above-described difference between the collector-emitter voltage (VCE1=0.7 V) of the transistor Q1 and the collector-emitter voltage (VCE2=20.7 V) of the transistor Q2, even when the current mirror circuit operates appropriately and allows the same amount of base current to flow through, for example, the transistors Q1 and Q2, the larger collector current is allowed to flow through the transistor Q2 than through the transistor Q1 in accordance with the collector-emitter voltage difference.

Such a collector current difference appears as, for example, the drive current difference between the first series drive circuit 21 and the second series drive circuit 22. When there is a difference in the drive currents, there is also a difference in the brightness of light emitted by the LEDs (D10 to D19) of the first series drive circuit 21 and the LEDs (D20 to D29) of the second series drive circuit 22. Because the light source device to which the LED drive circuit 1 according to the first embodiment is applied is used for, for example, backlighting using LEDs or the like, the above-described difference in the brightness of light emitted by the LEDs appears as lack of brightness uniformity of the surface emitting light sources. Therefore, it is preferable to reduce the difference in the brightness of light emitted by the LEDs as much as possible.

It is to be noted that, on the basis of the above points, the practical use of the LED drive circuit 1 according to the first embodiment is not negated, but rather the LED drive circuit 1 is sufficiently practical in actual applications.

Since the LED drive circuit 1 according to the first embodiment includes the voltage dropping circuit 11, the potential of the first series drive circuit 21 is increased, and, as a result, the collector voltages of the transistors in the current mirror circuit can be maintained within a normal level range. This makes it possible to make a practical application of the LED drive circuit including a combination of the constant-current circuit and the current mirror circuit.

Additionally, it is confirmed that, given the actually demanded display quality, the unevenness in brightness caused, in principle, by the difference in the collector-emitter voltages (VCE) does not cause a problem in practical application. In addition, the unevenness in brightness in this case can be further reduced by adjusting various settings including the actual arrangement of LEDs, the drive current level, and the voltage drop Vd caused by the voltage dropping circuit 11. It is also possible to take into consideration the distribution probability of the actual forward-direction voltage drop dispersion among LEDs and the distribution probability of voltage drop dispersion in the case of the LED series circuit. Then, the voltage drop Vd to be set for the voltage dropping circuit 11 is not necessarily be set on the assumption of the upper limit and the lower limit of the theoretically-expected voltage drop dispersion among the LED series circuits. It may be assumed that the voltage drops can be maintained within a narrower range, and hence the voltage drop Vd can be set to a smaller value. There is an advantage to the configuration according to the first embodiment of the present invention in that the appropriate current mirror circuit operation can be achieved without selecting forward-direction voltage drops across LEDs to form an LED series circuit. Alternatively, the smaller voltage drop Vd can be similarly set by performing a certain degree of selection of forward-direction voltage drops across LEDs so that the voltage drop dispersion among the LED series circuits is maintained within a predetermined range.

Figure 10:
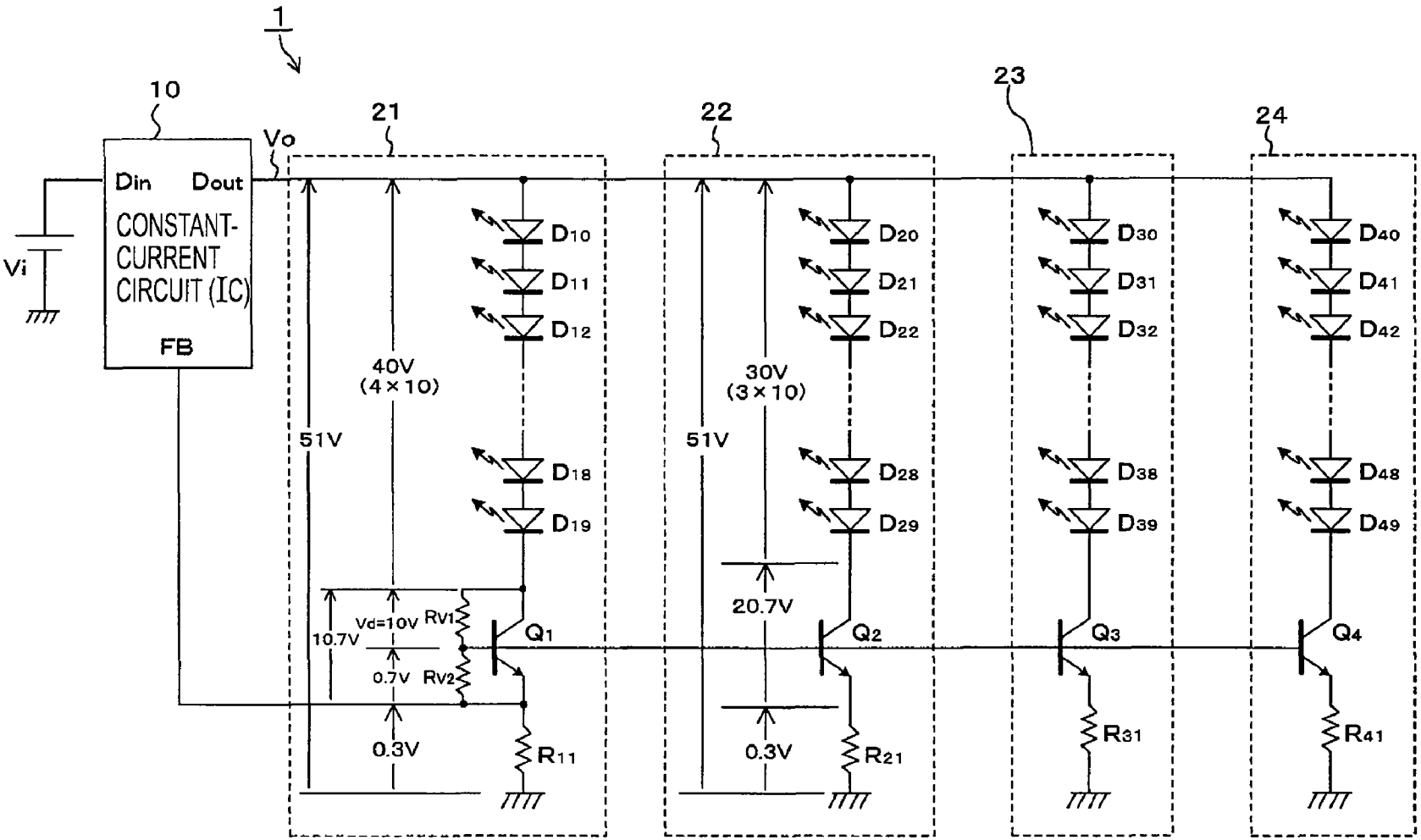
FIG. 10 is a circuit diagram showing an example of the configuration of the LED drive circuit according to a second embodiment of the present invention.

FIG. 10 shows an example of the configuration of the LED drive circuit 1 according to the second embodiment of the present invention. The LED drive circuit 1 shown in FIG. 10 can reduce the difference in brightness of light emitted by LEDs, which may occur in the LED drive circuit according to the first embodiment of the present invention, which has been described with reference to FIG. 9. In FIG. 10, the same parts as those in FIG. 1 are designated by the same reference numerals, and repeated descriptions thereof will be omitted.

In the LED drive circuit 1 shown in FIG. 10, the voltage dropping circuit 11, which is separate from the transistor Q1, is omitted. Instead of the voltage dropping circuit 11, a resistor Rv1 is connected between the collector and the base of the transistor Q1 forming the current mirror circuit in the first series drive circuit 21, and a resistor Rv2 is connected between the base and the emitter.

Since the resistors Rv1 and Rv2 are connected in this manner, a certain potential difference is generated between the collector and the base of the transistor Q1. In this case, the collector-emitter voltage (VCE1) of the transistor Q1 is a certain value obtained as:

$$VCE1 = VBE1 \times (Rv1 + Rv2)/Rv2 \quad (2)$$

wherein VBE1 is the base-emitter voltage of the transistor Q1.

On the assumption that the base-emitter voltage (VBE1) of the transistor Q1 is 0.7 V, the resistances of the resistors Rv1 and Rv2 are selected on the basis of equation (2), thereby setting the collector-emitter voltage (VCE1) to 10.7 V. In the first series drive circuit 21, as shown in FIG. 10, it can be regarded that there is a voltage drop of 10 V (10.7−0.7) serving as the collector-base voltage of the transistor Q1. In contrast, in the case of FIG. 1, the collector and the base of the transistor Q1 are connected to each other. Thus, the potential difference between the collector and the base is zero, and hence the collector-emitter voltage (VCE1) is 0.7 V, which is the same as the base-emitter voltage. In other words, according to the second embodiment, instead of the omitted voltage dropping circuit 11, a certain potential is generated as the collector-base voltage of the transistor Q1, thereby causing the voltage drop Vd.

In the circuit shown in FIG. 10, as in FIG. 9, on the assumption that the voltage drop dispersion among LEDs is within a range of 3.0 V to 4.0 V, the overall voltage drop in the LED series circuit (D10 to D19) of the first series drive circuit 21 is 40 V (=4.0 V×10) corresponding to the upper limit of the dispersion range, and the overall voltage drop in the LED series circuit (D20 to D29) of the second series drive circuit 22 is 30 V (=3.0 V×10) corresponding to the lower limit of the dispersion range. With respect to the transistor Q1, it is assumed that, as described above, the base-emitter voltage VBE1 is 0.7 V, and the collector-emitter voltage VCE1 is 10.7 V. The voltage drop caused by the emitter resistor R11 is 0.3 V.

In the first series drive circuit 21 in this case, there are a voltage drop of 40 V caused the LED series circuit (D10 to D19), a voltage drop of 10.7 V serving as the collector-emitter voltage (VCE1) of the transistor Q1, and a voltage drop of 0.3 V caused by the emitter resistor R11. Therefore, the voltage Vo applied across the entire first series drive circuit 21 is:

$$Vo=51\text{ V }(=40\text{ V}+10.7\text{ V}+0.3\text{ V}).$$

In this case, the collector-emitter voltage (VCE2) of the transistor Q2 in the second series drive circuit 22 is:

$$VCE2=20.7\text{ V }(=51\text{ V}-(30\text{ V}+0.3\text{ V})).$$

The fact that the collector-emitter voltage (VCE2) of the transistor Q2 is 20.7 V is the same as the case of FIG. 9.

However, according to the second embodiment, the collector-emitter voltage (VCE1) of the transistor Q1 is 10.7 V. Therefore, the difference between the collector-emitter voltage (VCE1) of the transistor Q1 and the collector-emitter voltage (VCE2) of the transistor Q2 is 10 V.

For the sake of comparison, in the case of FIG. 9, the collector-emitter voltage (VCE1) of the transistor Q1 is 0.7 V, and the collector-emitter voltage (VCE2) of the transistor Q2 is 20.7 V. The difference between the two collector-emitter voltages (VCE1 and VCE2) is 20 V.

According to the second embodiment, even with the same voltage drop Vd caused in, for example, the first series drive circuit 21, the difference between the collector-emitter voltages of the transistors Q1 and Q2 (|VCE1−VCE2|) is reduced compared to the first embodiment.

The fact that the difference between the collector-emitter voltages of the transistors Q1 and Q2 (|VCE1−VCE2|) is reduced means that, on the basis of the VCE-IC characteristics of transistors, the difference between the amounts of drive current flowing through the LEDs (D10 to D19) in the first series drive circuit 21 and through the LEDs (D20 to D29) in the second series drive circuit 22 is also reduced. As a result, the difference in brightness of light emitted by the LEDs (D10 to D19) in the first series drive circuit 21 and by the LEDs (D20 to D29) in the second series drive circuit 22 is also reduced. Consequently, the unevenness of brightness over the light-emitting surface in the case where the LEDs are used as, for example, light sources can be reduced.

FIG. 10 shows the case in which the voltage drop in the LED series circuit of the first series drive circuit 21 serving as the reference is 40 V, which is the upper limit of the voltage drop dispersion, and the voltage drop in the LED series circuit of the second series drive circuit 22 following the first series drive circuit 21 is 30 V, which is the lower limit of the voltage drop dispersion. In contrast, the following is the case in which the voltage drop in the LED series circuit of the first series drive circuit 21 is 30 V, which is the lower limit of the voltage drop dispersion, and the voltage drop in the LED series circuit of the second series drive circuit 22 is 40 V, which is the upper limit of the voltage drop dispersion.

In the first series drive circuit 21 in this case, there are a voltage drop of 30 V caused by the LED series circuit (D10 to D19), a voltage drop of 10.7 V serving as the collector-emitter voltage (VCE1) of the transistor Q1, and a voltage drop of 0.3 V caused by the emitter resistor R11. Therefore, the voltage Vo applied to the first series drive circuit 21 is:

$$Vo=41\text{ V }(=30\text{ V}+10.7\text{ V}+0.3\text{ V})$$

In this case, the collector-emitter voltage (VCE2) of the transistor Q2 in the second series drive circuit 22 is:

$$VCE2=0.7\text{ V }(=41\text{ V}-(40\text{ V}+0.3\text{ V}))$$

The magnitude relationship between the collector-emitter voltage (VCE1) of the transistor Q1 and the collector-emitter voltage (VCE2) of the transistor Q2 is opposite to the case of FIG. 10. However, the difference is 10 V, which is the same as the case of FIG. 10.

When the LED series circuits of the first series drive circuit 21 and the second series drive circuit 22 have the same voltage drop a (V), the voltage Vo applied to the first series drive circuit 21 is:

$$Vo=11\text{ V}+a(=a+10.7\text{ V}+0.3\text{ V})$$

In this case, the collector-emitter voltage (VCE2) of the transistor Q2 in the second series drive circuit 22 is:

$$VCE2=10.7\text{ V }(=11\text{ V}+a-(a+0.3\text{ V}))$$

That is, the collector-emitter voltage (VCE1) of the transistor Q1 and the collector-emitter voltage (VCE2) of the transistor Q2 are equal, and, theoretically, there is no difference in brightness of light emitted by the LEDs.

Therefore, according to the second embodiment, the difference (|VCE1−VCE2|) between the collector-emitter voltage (VCE1) of the transistor Q1 serving as the reference and the collector-emitter voltage (VCE2) of the transistor Q2 is maintained within a range of ±10 V.

In the case where, as described above, the voltage drop levels are the same in the LED series circuits of the first series drive circuit 21 and the second series drive circuit 22, there is an advantage to having the same collector-emitter voltages (VCE1 and VCE2) of the transistors Q1 and Q2, which will be described below.

Actually, voltage drops in LED series circuits including randomly-selected LEDs are expected to be dispersed around a predetermined value, which corresponds to the highest incidence rate within a dispersion range, and the farther from this value, the lower the incidence rate. In other words, the actual dispersion of voltage drops Vd in the LED series circuits can be regarded as occurring within a range near the above-described value having the highest incidence rate.

On the basis of this point and the fact that, when the voltage drop levels are the same in the LED series circuits of the first series drive circuit 21 and the second series drive circuit 22, the collector-emitter voltages (VCE1 and VCE2) of the transistors Q1 and Q2 are equal, the difference in brightness of light emitted by the LEDs of the light source device to which the second embodiment is actually applied can be maintained within a very narrow range.

Figure 11:
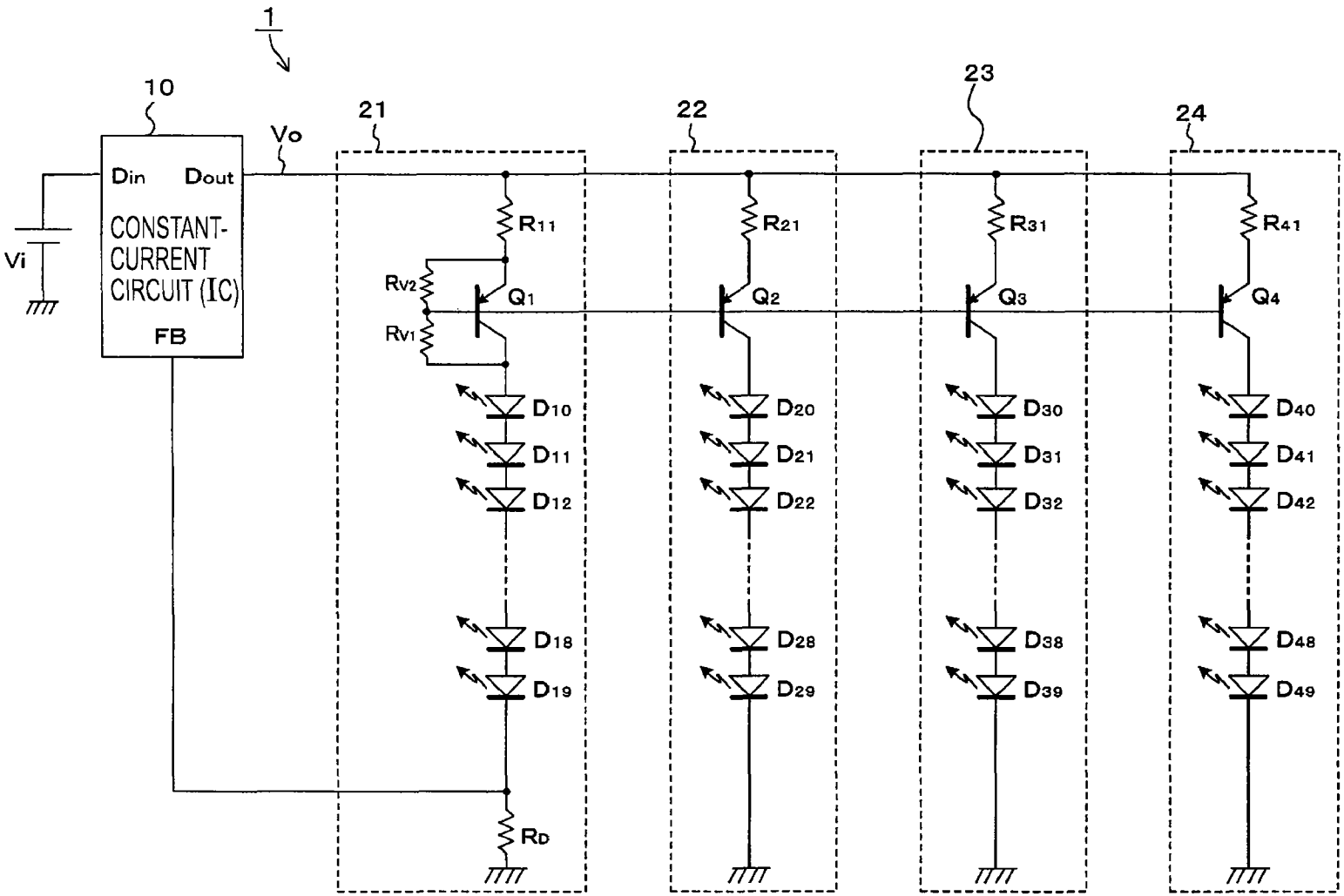
FIG. 11 is a circuit diagram showing a modification of the circuit configuration of the current mirror circuit according to the second embodiment.

FIG. 11 shows a modification of the circuit configuration of the current mirror circuit according to the second embodiment. In FIG. 11, the same parts as those in FIGS. 10 and 8 are designated by the same reference numerals, and repeated descriptions thereof will be omitted.

The modification shown in FIG. 11 is obtained by applying the configuration of the modification of the first embodiment shown in FIG. 8 to the configuration of the second embodiment. More specifically, the transistors Q1, Q2, Q3, and Q4 for forming the current mirror circuit are PNP transistors. In the first series drive circuit 21, the emitter of the transistor Q1 is connected to the line of the voltage Vo via the emitter resistor R11, and the collector is connected to the anode end (anode of D10) of the LED series circuit (D10 to D19). Then, with respect to the transistor Q1, as in the case of the FIG. 10, the resistor Rv1 is connected between the collector and the base of the transistor Q1, and the resistor Rv2 is connected between the base and the emitter.

In the second, third, and fourth series drive circuits 22, 23, and 24, the transistors Q2, Q3, and Q4 are connected in the same manner as in the first series drive circuit 21. Then, the bases of the transistors Q1, Q2, Q3, and Q4 are connected to one another.

In the first series drive circuit 21, the detection resistor Rd for detecting the drive current level is disposed between the cathode end (cathode of D19) of the LED series circuit and the ground, and the detection output is supplied to the feedback terminal FB of the constant-current circuit 10.

With this configuration, the first to fourth series drive circuits 21 to 24 are connected in parallel with the line of the voltage Vo, which is the output of the constant-current circuit 10. With respect to the first to fourth series drive circuits 21 to 24, the current mirror circuit is formed by the PNP transistors.

Even with this configuration, a potential corresponding to the voltage drop Vd can be obtained as the collector-base voltage of the transistor Q1 in the first series drive circuit 21, and hence a certain level greater than the base-emitter voltage can be obtained as the collector-emitter voltage (VCE1). As in the configuration of FIG. 10, with respect to the voltage drop dispersion among the LED series circuits, the differences between the collector-emitter voltage of the transistor Q1 and the collector-emitter voltages of the other transistors Q2, Q3, and Q4 can be reduced within a predetermined range of positive and negative values with respect to zero as the reference.

The collector-emitter voltage (VCE1) of the transistor Q1 can be expressed by equation (2). The base-emitter voltage of an actual bipolar transistor has temperature characteristics (e.g., −2 mV/° C.). Therefore, the collector-emitter voltage (VCE1) of the transistor Q1 varies with temperature.

Figure 12:
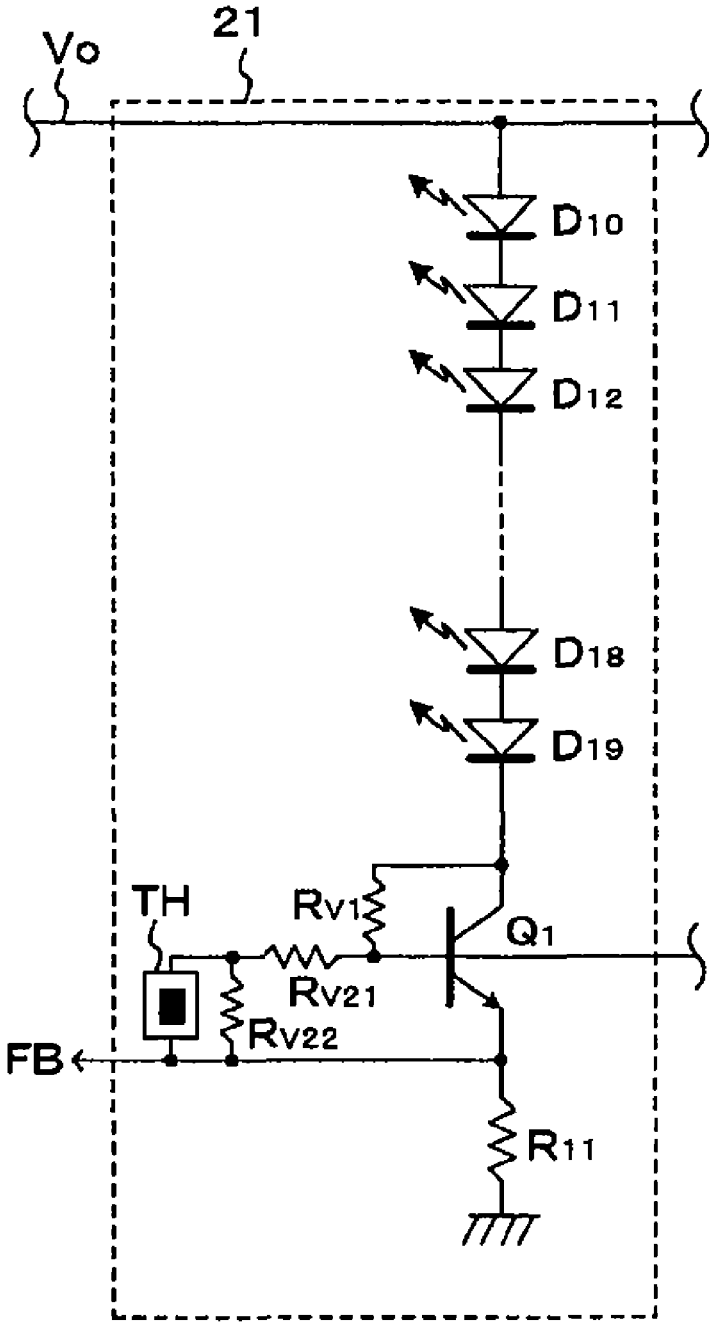
FIG. 12 is a circuit diagram showing a modification of a circuit for setting a collector-emitter voltage of a transistor according to the second embodiment.

FIG. 12 shows, as a modification of the second embodiment, the configuration in which temperature compensation is performed for variations in the collector-emitter voltage (VCE1). Although only the first series drive circuit 21 is shown in FIG. 12, the remaining parts may be the same as those in, for example, FIG. 10.

Referring to FIG. 12, as in the case of FIG. 10, only the resistor Rv1 is connected between the collector and the base of the transistor Q1, and resistors Rv21 and Rv22 and a thermistor TH are connected between the base and the emitter in the following manner. In this case, the resistor Rv2 shown in FIG. 10 is divided into the resistors Rv21 and Rv22, and a series circuit including the series-connected resistors Rv21 and Rv22 is connected between the base and the emitter. In this case, the series circuit including the series-connected resistors Rv21 and Rv22 is connected in such a manner that one end at the side of the resistor Rv21 is connected to the base and the other end at the side of the resistor Rv22 is connected to the emitter. The thermistor TH is connected in parallel with the resistor Rv22. Alternatively, as shown in FIG. 10, the thermistor TH may be connected in parallel with the resistor Rv2 connected between the base and the emitter. In the case shown in FIG. 12, however, the resistor Rv2 is divided into the resistors Rv21 and Rv22 in consideration of variations in the resistance, and the thermistor TH is connected in parallel with one resistor Rv22.

When there is a temperature change in the circuit, the resistance of the thermistor TH changes. This change in the resistance of the thermistor TH induces a change in the resistance of a parallel circuit including the parallel-connected resistor Rv22 and thermistor TH. Since the parallel circuit including the parallel-connected resistor Rv22 and thermistor TH is connected to the resistor Rv21 connected between the base and the emitter, the change in the resistance of the thermistor TH produces the same action as varying the resistance of the resistor (Rv2) disposed between the base and the emitter of the transistor Q1. The change in the resistance (Rv2) between the base and the emitter of the transistor Q1 corresponds to, in association with equation (2), the change in the ratio of the resistances of the resistor Rv2 and the resistor Rv1. As a result, this change induces a change in the collector-emitter voltage (VCE1) of the transistor Q1. Because of the change in the collector-emitter voltage (VCE1) of the transistor Q1, the change in the collector-emitter voltage due to the temperature characteristics is cancelled, thereby enabling temperature compensation.

Figure 13:
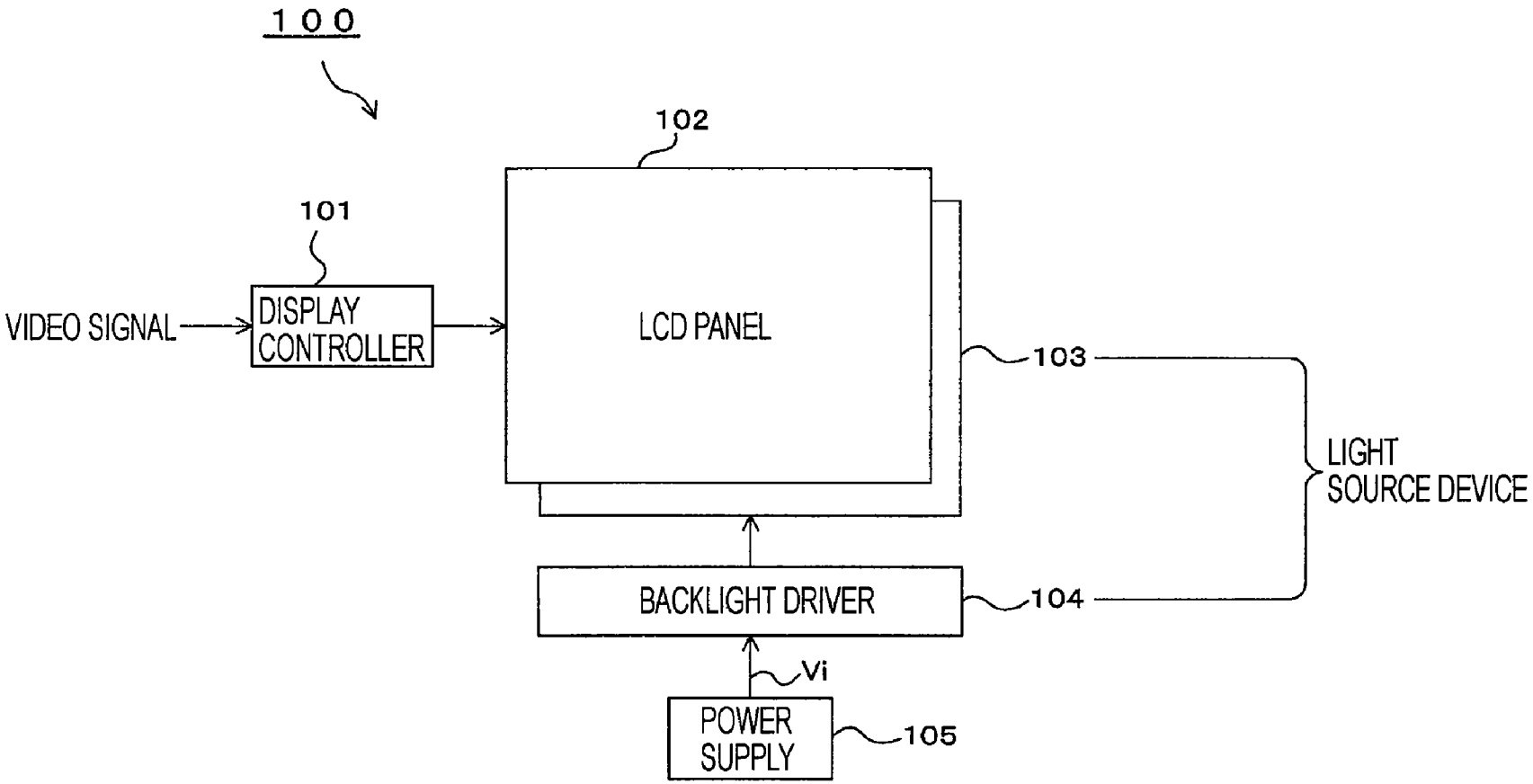
FIG. 13 is a diagram showing an example of the configuration of an LCD including a light source device to which the LED drive circuit according to the first and second embodiments is applicable.

FIG. 13 schematically shows the configuration of a liquid crystal display (LCD) 100 serving as an example of a display device to which the above-described LED drive circuit 1 according to the first or second embodiment is applicable.

The LCD 100 shown in FIG. 13 includes a liquid crystal display panel (LCD panel) 102 corresponding to a display screen and a backlight unit 103 disposed on the back of the LCD panel 102. The LCD panel 102 is fabricated by, as is generally known, sealing in a liquid crystal layer in glass or the like and arranging pixel switches corresponding to predetermined resolutions in a matrix pattern on a semiconductor substrate or the like.

In association with the LED drive circuit 1 according to the embodiments, the backlight unit 103 is configured by two-dimensionally arranging a predetermined number of (e.g., 40) white LEDs serving as light sources in a predetermined pattern. The backlight unit 103 irradiates the LCD panel 102 with white light from the back to the front.

The LEDs included in the backlight unit 103 emit light when driven by a backlight driver 104 allowing current to flow through the LEDs. The backlight driver 104 in this case is operated by a direct-current (DC) voltage Vi supplied from a power supply 105.

The pixel switches in the LCD panel 102 are driven by a display controller 101. The display controller 101 receives a display video signal and controls on and off of the pixel switches in accordance with the input video signal by performing horizontal and vertical scanning driving with respect to the LCD panel 102. By driving the LCD panel 102 so as to change the deflection direction of the liquid crystal layer corresponding to the pixel switches, light trying to pass through the LCD panel 102 from the back to the front is modulated. As a result, an image is displayed on the screen of the LCD panel 102.

Referring to FIG. 13, the light source device to which the LED drive circuit 1 according to the first and second embodiments is applied can be regarded as a device combining the LEDs (D10 to D19, D20 to D29, D30 to D39, and D40 to D49) serving as the light sources included in the backlight unit 103 and the drive circuit serving as the backlight driver 104 for driving the LEDs. The backlight driver 104 in this case includes, for example, the constant-current circuit 10, the transistors Q1, Q2, Q3, and Q4 forming the current mirror circuit, and its peripheral elements (the emitter resistor R11, the resistors Rv1 and Rv2, and the thermistor TH (second embodiment)). According to the first embodiment, the voltage dropping circuit 11 is also included. When the LEDs are employed in the voltage dropping circuit 11, as shown in FIG. 3, these LEDs are physically included in the backlight unit 103.

The present invention is not limited to the above-described embodiments.

For example, the number of LEDs connected in series to form each series circuit forming the LED drive circuit and the number of series circuits connected in parallel may be changed appropriately. The details of the circuit configuration of the current mirror circuit and the like may be changed appropriately. For example, the transistors for forming the current mirror circuit may be, in addition to the bipolar transistors, other types of amplifiers including FETs.

According to the embodiments, on the assumption that the LED drive circuit is applied to the light source device for the LCD, the configuration for achieving white light using white LEDs is employed.

In recent years, however, the technology for causing LEDs corresponding to, for example, the three primary colors red, green, and blue or more than the three primary colors to emit light and combining these colors of light to achieve white light has become known. The present invention is also applicable to, for example, the configuration of a display device in which LEDs of different colors are driven to emit light. In addition, the present invention is applicable to, in addition to the LCD panel, a display employing a display device involving a light source.

In addition to being used as light sources for an LCD, LEDs have become used as light sources for, for example, illumination. The present invention is also applicable to a circuit for driving light sources. When LEDs are used as light sources for such illumination, the colors of the LEDs may be various and not limited to a single color.

It should be understood by those skilled in the art that various modifications, combinations, sub-combinations, and alterations may occur depending on design requirements and other factors insofar as they are within the scope of the appended claims or the equivalents thereof.

What is claimed is:

1. A light-emitting diode drive circuit comprising:

a plurality of series drive circuits each including a predetermined number of light-emitting diodes connected in series;

a constant-current circuit operating to output a constant amount of current to, among the plurality of series drive circuits, a series drive circuit serving as a reference, the plurality of series drive circuits being connected in parallel with the current output;

a current mirror circuit operable to allow the same amount of current to flow through the plurality of series drive circuits, the current mirror circuit including a transistor in each of the plurality of series drive circuits; and a voltage dropping circuit operable to cause a voltage drop of a predetermined level in the series drive circuit serving as the reference, the voltage dropping circuit being disposed in series with the light-emitting diodes forming the series drive circuit serving as the reference, wherein, bases of the transistors of the current mirror drive circuit are connected to each other.

2. The light-emitting diode drive circuit according to claim 1, wherein the voltage dropping circuit includes a voltage dropping element.

3. A light-emitting diode drive circuit comprising:

a plurality of series drive circuits each including a predetermined number of light-emitting diodes connected in series;

a constant-current circuit operating to output a constant amount of current to, among the plurality of series drive circuits, a series drive circuit serving as a reference, the plurality of series drive circuits being connected in parallel with the current output;

a current mirror circuit operable to allow the same amount of current to flow through the plurality of series drive circuits; and a voltage dropping circuit operable to cause a voltage drop of a predetermined level in the series drive circuit serving as the reference, the voltage dropping circuit being disposed in series with the light-emitting diodes forming the series drive circuit serving as the reference, wherein, the voltage dropping circuit includes a voltage dropping element, and the voltage dropping circuit includes at least one series-connected diode serving as the voltage dropping element.

4. A light-emitting diode drive circuit comprising:

a plurality of series drive circuits each including a predetermined number of light-emitting diodes connected in series;

a constant-current circuit operating to output a constant amount of current to, among the plurality of series drive circuits, a series drive circuit serving as a reference, the plurality of series drive circuits being connected in parallel with the current output;

a current mirror circuit operable to allow the same amount of current to flow through the plurality of series drive circuits; and a voltage dropping circuit operable to cause a voltage drop of a predetermined level in the series drive circuit serving as the reference, the voltage dropping circuit being disposed in series with the light-emitting diodes forming the series drive circuit serving as the reference, wherein, the voltage dropping circuit includes a voltage dropping element, and the voltage dropping circuit includes at least one series-connected light-emitting diode serving as the voltage dropping element.

5. A light-emitting diode drive circuit comprising:

a plurality of series drive circuits each including a predetermined number of light-emitting diodes connected in series;

a constant-current circuit operating to output a constant amount of current to, among the plurality of series drive circuits, a series drive circuit serving as a reference, the plurality of series drive circuits being connected in parallel with the current output;

a current mirror circuit operable to allow the same amount of current to flow through the plurality of series drive circuits; and a voltage dropping circuit operable to cause a voltage drop of a predetermined level in the series drive circuit serving as the reference, the voltage dropping circuit being disposed in series with the light-emitting diodes forming the series drive circuit serving as the reference, wherein, the voltage dropping circuit includes a voltage dropping element, and the voltage dropping circuit includes a resistance element serving as the voltage dropping element.

6. A light-emitting diode drive circuit comprising:

a plurality of series drive circuits each including a predetermined number of light-emitting diodes connected in series;

a constant-current circuit operating to output a constant amount of current to, among the plurality of series drive circuits, a series drive circuit serving as a reference, the plurality of series drive circuits being connected in parallel with the current output;

a current mirror circuit operable to allow the same amount of current to flow through the plurality of series drive circuits; and a voltage dropping circuit operable to cause a voltage drop of a predetermined level in the series drive circuit serving as the reference, the voltage dropping circuit being disposed in series with the light-emitting diodes forming the series drive circuit serving as the reference, wherein, the voltage dropping circuit includes a voltage dropping element, the voltage dropping circuit includes a resistance element serving as the voltage dropping element, and the resistance element is a detection resistor for detecting the current flowing through the series drive circuit serving as the reference and feeding back a detection result to the constant-current circuit.

7. A light-emitting diode drive circuit comprising:

a plurality of series drive circuits each including a predetermined number of light-emitting diodes connected in series;

a constant-current circuit operating to output a constant amount of current to, among the plurality of series drive circuits, a series drive circuit serving as a reference, the plurality of series drive circuits being connected in parallel with the current output;

a current mirror circuit operable to allow the same amount of current to flow through the plurality of series drive circuits; and a voltage dropping circuit operable to cause a voltage drop of a predetermined level in the series drive circuit serving as the reference, the voltage dropping circuit being disposed in series with the light-emitting diodes forming the series drive circuit serving as the reference wherein, the voltage dropping circuit includes a transistor disposed so that an input terminal and an output terminal of the transistor are connected in series with the series drive circuit, and resistors including one disposed between the input terminal and a control terminal and another disposed between the output terminal and the control terminal.

8. The light-emitting diode drive circuit according to claim 1, wherein the voltage dropping circuit is divided into at least two separate voltage dropping circuits disposed in the series drive circuit serving as the reference.

9. A light source device comprising:

a plurality of series drive circuits each including a predetermined number of light-emitting diodes connected in series, the light-emitting diodes serving as light sources;

a constant-current circuit operating to output a constant amount of current to, among the plurality of series drive circuits, a series drive circuit serving as a reference, the plurality of series drive circuits being connected in parallel with the current output;

a current mirror circuit operable to allow the same amount of current to flow through the plurality of series drive circuits, the current mirror drive circuit including a transistor in each of the plurality of series drive circuits; and a voltage dropping circuit operable to cause a voltage drop of a predetermined level in the series drive circuit serving as the reference, the voltage dropping circuit being disposed in series with the light-emitting diodes forming the series drive circuit serving as the reference,.

wherein bases of the transistors of the current mirror drive circuit are connected to each other.

10. A display device comprising:

a light source device; and an image display panel operable to display an image using light emitted from the light source device;

wherein the light source device includes a plurality of series drive circuits each including a predetermined number of light-emitting diodes connected in series, the light-emitting diodes serving as light sources, a constant-current circuit operating to output a constant amount of current to, among the plurality of series drive circuits, a series drive circuit serving as a reference, the plurality of series drive circuits being connected in parallel with the current output, a current mirror circuit operable to allow the same amount of current to flow through the plurality of series drive circuits, the current mirror drive circuit including a transistor in each of the plurality of series drive circuits, and a voltage dropping circuit operable to cause a voltage drop of a predetermined level in the series drive circuit serving as the reference, the voltage dropping circuit being disposed in series with the light-emitting diodes forming the series drive circuit serving as the reference, wherein, bases of the transistors of the current mirror drive circuit are connected to each other.

11. A light-emitting diode drive circuit comprising:

a plurality of series drive circuits each including a predetermined number of light-emitting diodes connected in series;

a constant-current circuit operating to output a constant amount of current to, among the plurality of series drive circuits, a series drive circuit serving as a reference, the plurality of series drive circuits being connected in parallel with the current output;

a current mirror circuit operable to allow the same amount of current to flow through the plurality of series drive circuits, the current mirror drive circuit including a transistor in each of the plurality of series drive circuits; and a voltage dropping circuit operable to generate, in a current mirror transistor forming the current mirror circuit, which is disposed so that an input terminal and an output terminal of the current mirror transistor are connected in series with the series drive circuit serving as the reference, a certain voltage between the output terminal and a control terminal, wherein, bases of the transistors of the current mirror drive circuit are connected to each other.

12. A light-emitting diode drive circuit comprising:

a plurality of series drive circuits each including a predetermined number of light-emitting diodes connected in series;

a constant-current circuit operating to output a constant amount of current to, among the plurality of series drive circuits, a series drive circuit serving as a reference, the plurality of series drive circuits being connected in parallel with the current output;

a current mirror circuit operable to allow the same amount of current to flow through the plurality of series drive circuits; and a voltage dropping circuit operable to generate, in a current mirror transistor forming the current mirror circuit, which is disposed so that an input terminal and an output terminal of the current mirror transistor are connected in series with the series drive circuit serving as the reference, a certain voltage between the output terminal and a control terminal wherein, the voltage dropping circuit includes a resistor disposed between the input terminal and the control terminal of the current mirror transistor and a resistor disposed between the output terminal and the control terminal.

13. A light source device comprising:

a plurality of series drive circuits each including a predetermined number of light-emitting diodes connected in series, the light-emitting diodes serving as light sources;

a constant-current circuit operating to output a constant amount of current to, among the plurality of series drive circuits, a series drive circuit serving as a reference, the plurality of series drive circuits being connected in parallel with the current output;

a current mirror circuit operable to allow the same amount of current to flow through the plurality of series drive circuits, the current mirror drive circuit including a transistor in each of the plurality of series drive circuits; and a voltage dropping circuit operable to generate, in a current mirror transistor forming the current mirror circuit, which is disposed so that an input terminal and an output terminal of the current mirror transistor are connected in series with the series drive circuit serving as the reference, a certain voltage between the output terminal and a control terminal, wherein, bases of the transistors of the current mirror drive circuit are connected to each other.

14. A display device comprising:

a light source device; and an image display panel operable to display an image using light emitted from the light source device;

wherein the light source device includes a plurality of series drive circuits each including a predetermined number of light-emitting diodes connected in series, the light-emitting diodes serving as light sources, a constant-current circuit operating to output a constant amount of current to, among the plurality of series drive circuits, a series drive circuit serving as a reference, the plurality of series drive circuits being connected in parallel with the current output, a current mirror circuit operable to allow the same amount of current to flow through the plurality of series drive circuits, the current mirror drive circuit including a transistor in each of the plurality of series drive circuits, and a voltage dropping circuit operable to generate, in a current mirror transistor forming the current mirror circuit, which is disposed so that an input terminal and an output terminal of the current mirror transistor are connected in series with the series drive circuit serving as the reference, a certain voltage between the output terminal and a control terminal, wherein, bases of the transistors of the current mirror drive circuit are connected to each other.

* * * * *